US011183101B2

(12) United States Patent
Orio et al.

(10) Patent No.: US 11,183,101 B2
(45) Date of Patent: Nov. 23, 2021

(54) COMPENSATION TECHNOLOGY FOR DISPLAY PANEL

(71) Applicant: Synaptics Incorporated, San Jose, CA (US)

(72) Inventors: Masao Orio, Tokyo (JP); Hirobumi Furihata, Tokyo (JP); Susumu Saito, Tokyo (JP); Masaaki Okawa, Tokyo (JP); Takashi Nose, Tokyo (JP)

(73) Assignee: Synaptics Incorporated, San Jose, CA (US)

( * ) Notice: Subject to any disclaimer, the term of this patent is extended or adjusted under 35 U.S.C. 154(b) by 0 days.

(21) Appl. No.: 16/763,981

(22) PCT Filed: Nov. 15, 2018

(86) PCT No.: PCT/US2018/061258
§ 371 (c)(1),
(2) Date: May 13, 2020

(87) PCT Pub. No.: WO2019/099654
PCT Pub. Date: May 23, 2019

(65) Prior Publication Data

US 2020/0279519 A1 Sep. 3, 2020

Related U.S. Application Data

(60) Provisional application No. 62/587,355, filed on Nov. 16, 2017.

(51) Int. Cl.
*G09G 3/20* (2006.01)
*G09G 3/3233* (2016.01)

(52) U.S. Cl.
CPC ..... *G09G 3/2011* (2013.01); *G09G 3/3233* (2013.01); *G09G 2320/0233* (2013.01);
(Continued)

(58) Field of Classification Search
CPC ... G09G 2320/0223; G09G 2320/0233; G09G 2320/0276; G09G 2320/0285;
(Continued)

(56) References Cited

U.S. PATENT DOCUMENTS

2004/0150590 A1* 8/2004 Cok ..... G09G 3/3208 345/76
2005/0023986 A1* 2/2005 Mizukoshi ..... G09G 3/3208 315/169.3
(Continued)

FOREIGN PATENT DOCUMENTS

KR 10-2017-0073771 A 6/2017

OTHER PUBLICATIONS

International Search Report issued in corresponding application No. PCT/US2018/061258 dated Mar. 14, 2019 (3 pages).
(Continued)

*Primary Examiner* — Richard J Hong
(74) *Attorney, Agent, or Firm* — Ferguson Braswell Frasier Kubasta PC

(57) ABSTRACT

A display driver comprises: digital gamma circuitry configured to generate a voltage data based on an image data for a pixel of interest; compensating circuitry configured to calculate a total current of the display panel; and correction circuitry. The correction circuitry is configured to correct the voltage data, based on the calculated total current.

13 Claims, 27 Drawing Sheets

(52) U.S. Cl.
CPC ..... *G09G 2320/0276* (2013.01); *G09G 2320/0285* (2013.01); *G09G 2320/0673* (2013.01); *G09G 2360/145* (2013.01)

(58) Field of Classification Search
CPC ..... G09G 2320/0673; G09G 2330/00; G09G 2360/145; G09G 3/006; G09G 3/20; G09G 3/2011; G09G 3/3233; G09G 5/10; G09G 3/3216; G09G 3/3208; G09G 3/3225; G09G 3/3291; G09G 3/3607; H04B 7/005
See application file for complete search history.

(56) References Cited

U.S. PATENT DOCUMENTS

2007/0103411 A1* 5/2007 Cok ..... G09G 3/3216 345/82
2008/0231566 A1* 9/2008 Naugler ..... G09G 3/3291 345/82
2010/0149162 A1 6/2010 Park et al.
2010/0149226 A1* 6/2010 Byun ..... G09G 3/3225 345/690
2010/0225634 A1* 9/2010 Levey ..... G09G 3/3208 345/212
2011/0231126 A1* 9/2011 Ghosh ..... G09G 3/006 702/64
2012/0236041 A1 9/2012 Oh
2013/0002618 A1* 1/2013 Furihata ..... G09G 3/3607 345/204
2013/0135272 A1 5/2013 Park
2014/0204130 A1* 7/2014 Sugiyama ..... G09G 3/20 345/690
2016/0117982 A1 4/2016 Fujii
2016/0163258 A1* 6/2016 Cho ..... G09G 3/3225 345/690
2016/0307511 A1* 10/2016 Fujii ..... G09G 3/20
2017/0032742 A1* 2/2017 Piper ..... G09G 3/3233
2018/0190196 A1* 7/2018 Kwon ..... G09G 3/3233
2020/0051508 A1* 2/2020 Tan ..... G09G 3/3233
2020/0143750 A1* 5/2020 Gao ..... G09G 3/3291
2020/0143751 A1* 5/2020 Byun ..... G09G 3/3233

OTHER PUBLICATIONS

Written Opinion of the International Searching Authority issued in corresponding application No. PCT/US2018/061258 dated Mar. 14, 2019 (5 pages).

* cited by examiner

COMPENSATION TECHNOLOGY FOR DISPLAY PANEL

CROSS REFERENCE

This application claims the benefit of provisional application No. 62/587,355, filed on Nov. 16, 2017, the disclosure of which is incorporated herein by reference in its entirety.

FIELD

The present disclosure generally relates to compensation technologies for display panels and display devices.

BACKGROUND

A display device may be equipped with a display panel such as an organic light emitting diode (OLED) display panel, a liquid crystal display (LCD) panel, and a plasma display panel. A display panel may be driven by a display driver. A display device equipped with a display panel may be tested by a test system, and parameter settings of the display driver may be adjusted based on a test result.

SUMMARY

In one or more embodiments, a display driver comprises: digital gamma circuitry configured to generate a voltage data based on an image data for a pixel of interest; compensating circuitry configured to calculate a total current of a display panel; and correction circuitry configured to correct the voltage data, based on the calculated total current.

In one or more embodiments, a display device comprises a display panel and a display driver. The display driver is configured to: generate a voltage data based on an image data for a pixel of interest; calculate a total current of a display panel; and correct the voltage data, based on the calculated total current.

In one or more embodiments, a method comprises: generating a voltage data based on an image data for a pixel of interest; calculating a total current of a display panel; and correcting the voltage data, based on the calculated total current.

BRIEF DESCRIPTION OF THE DRAWINGS

So that the manner in which the above recited features of the present disclosure may be understood in detail, a more particular description of the disclosure, briefly summarized above, may be had by reference to embodiments, some of which are illustrated in the appended drawings. It is to be noted, however, that the appended drawings illustrate only some embodiments of this disclosure and are therefore not to be considered limiting of its scope, for the disclosure may admit to other equally effective embodiments.

DETAILED DESCRIPTION

Figure 1:
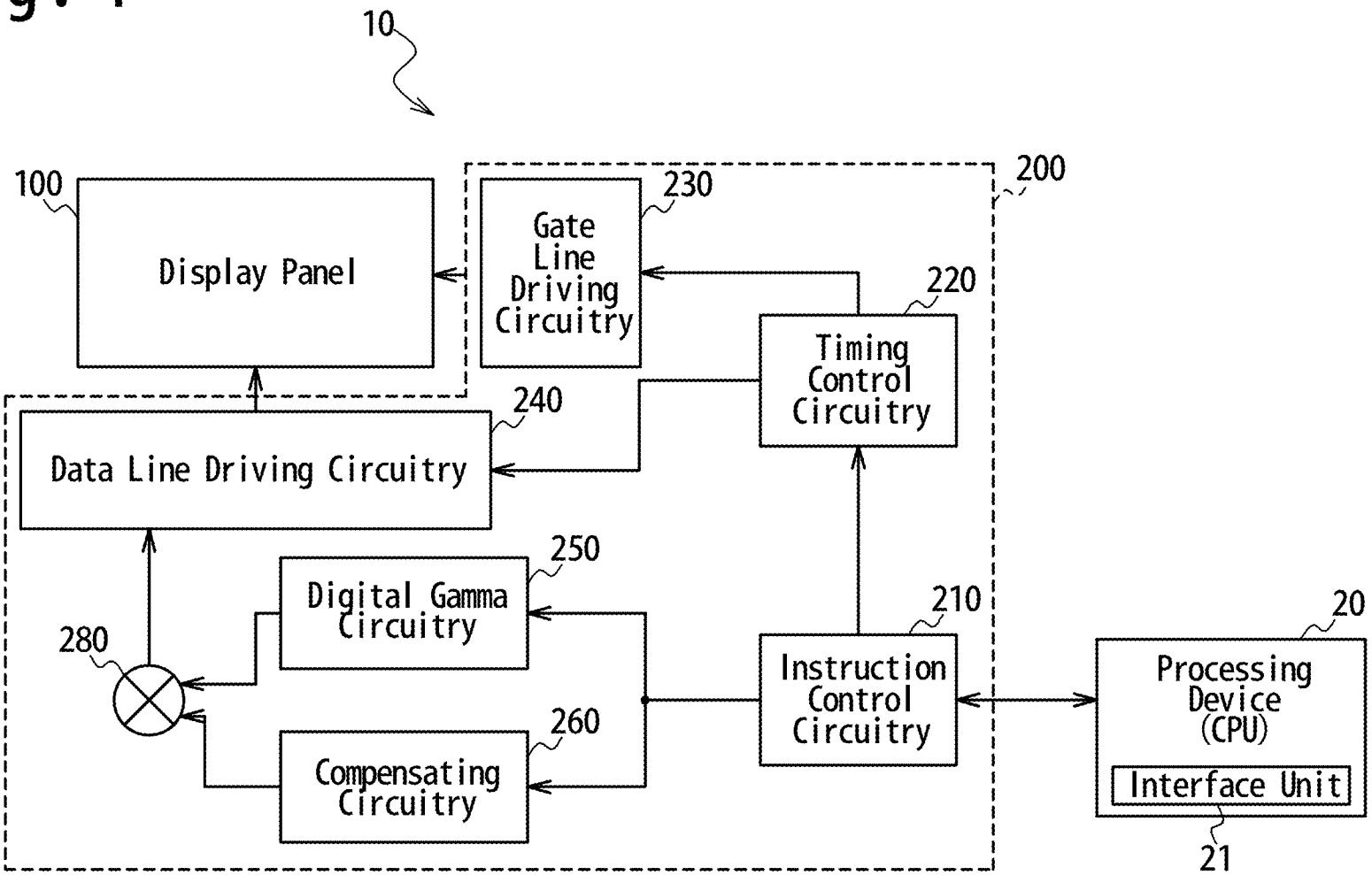
FIG. 1 illustrates an example configuration of a display device, according to one or more embodiments.

In one or more embodiments, as illustrated in FIG. 1, a display device 10 comprises a display panel 100 and a display driver 200 electrically connected to the display panel 100. The display driver 200 may include a display driver integrated circuitry (IC). In one or more embodiments, the display driver 200 is configured to drive the display panel 100 based on image data and/or control commands received from a processing device 20. In one or more embodiments, the processing device 20 may comprise a central processing unit (CPU), a random-access memory (RAM), a read-only memory (ROM), and an interface unit 21.

In one or more embodiments, the display panel 100 may include a self-luminous display panel such as an organic light emitting diode (OLED) display panel. In one or more embodiments, the display panel 100 comprises data lines, gate lines, and pixels arrayed in rows and columns. In one or more embodiments, each pixel comprises a plurality of subpixels configured to emit light of different colors. In one or more embodiments, each pixel comprises, but not limited to this, an R subpixel configured to emit red light, a G subpixel configured to emit green light, and a B subpixel configured to emit blue light. Each pixel may additionally comprise a subpixel configured to emit light of a different color.

In one or more embodiments, each subpixel comprises an OLED element configured to emit light upon application of a drive current. In one or more embodiments, each subpixel is connected to a corresponding gate line and a corresponding data line. In one or more embodiments, a subpixel is configured to allow the OLED element to emit light based on a drive signal received from the display driver 200 via the corresponding data line when the corresponding gate line is selected. In one or more embodiments, the display panel 100 comprises power lines configured to supply a power supply voltage to the respective subpixels, and the subpixels each are configured to operate on the power supply voltage to emit light of red, green or blue.

In one or more embodiments, the display driver 200 comprises instruction control circuitry 210, timing control circuitry 220, gate line driving circuitry 230, data line driving circuitry 240, digital gamma circuitry 250, compensating circuitry 260, and voltage data correction circuitry 280.

In one or more embodiments, the instruction control circuitry 210 is configured to transfer to the digital gamma circuitry 250 the image data received from the processing device 20. In one or more embodiments, the instruction control circuitry 210 is further configured to operate the timing control circuitry 220 to control drive timing of the gate lines by the gate line driving circuitry 230 and drive timing of the data lines by the data line driving circuitry 240.

Figure 2:
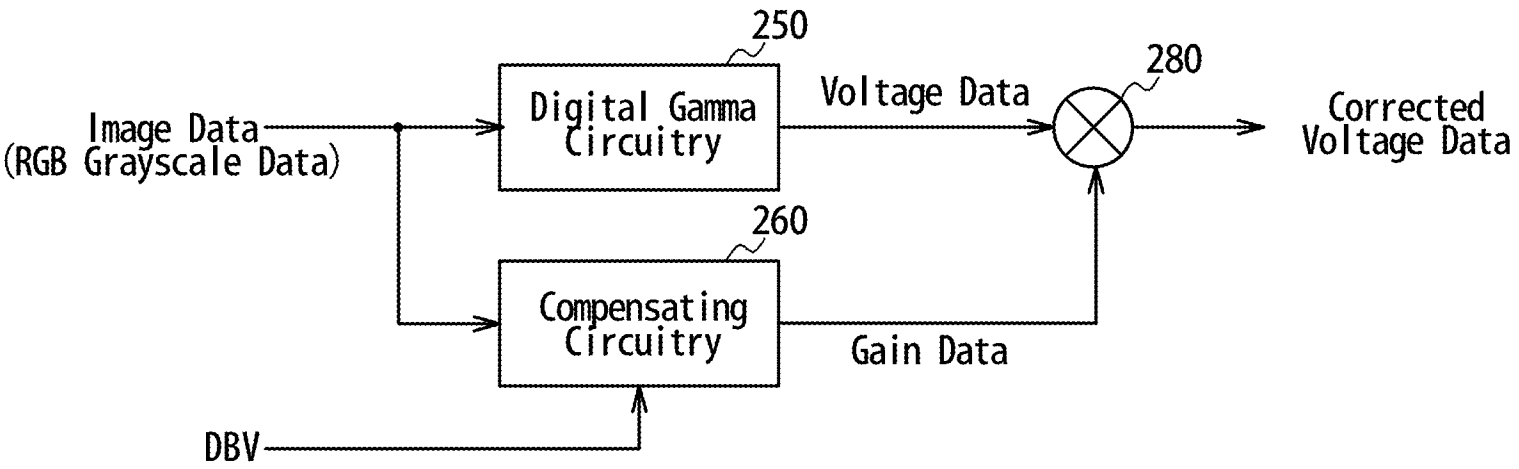
FIG. 2 illustrates an example configuration of a display driver, according to one or more embodiments.

In one or more embodiments, as illustrated in FIG. 2, the digital gamma circuitry 250 is configured to convert the image data received from the instruction control circuitry 210 into voltage data that specify voltage levels of drive signals supplied to the respective subpixels of the respective pixels of the display panel 100. In one or more embodiments, the digital gamma circuitry 250 is configured to output the voltage data to the voltage data correction circuitry 280. In one or more embodiments, the image data may comprise an RGB grayscale data that describes grayscale values of the R subpixel, G subpixel, and B subpixel of a pixel of interest, and the digital gamma circuitry 250 may be configured to convert the RGB grayscale data into an RGB voltage data that specifies voltage levels of drive signals to be supplied to the R subpixel, the G subpixel, and the B subpixel of the pixel of interest.

In one or more embodiments, the digital gamma circuitry 250 is configured to perform digital gamma correction on the image data received from the instruction control circuitry 210 to generate the voltage data. In one or more embodiments, the digital gamma circuitry 250 is configured to flexibly or programmably control the digital gamma correction. This may offer a smooth gamma property, which is a relationship between a grayscale value specified in an image data and a luminance level of a subpixel.

In one or more embodiments, the compensating circuitry 260 and the voltage data correction circuitry 280 are configured to compensate for voltage drops generated over the power lines that deliver a power supply voltage to respective subpixels in the display panel 100. The voltage drops over the power lines in the display panel 100 may cause mura or display luminance unevenness in a frame image displayed on the display panel 100. In one or more embodiments, generation of mura is suppressed through the voltage drop compensation.

In one or more embodiments, the voltage drop compensation is performed based on a calculated total current of the display panel 100. In one or more embodiments, the total current is calculated based on a sum of pixel currents which flow in the respective pixels. Voltage drops over power lines in the display panel 100 may depend on the total current of the display panel 100, and therefore the use of the calculated total current may provide improved voltage drop compensation.

In one or more embodiments, the total current is calculated based on a total luminance level of the display panel 100, and the voltage drop is compensated based on the total luminance level of the display panel 100. In one or more embodiments, the total luminance level is calculated based on a sum of pixel luminance levels of the respective pixels of the display panel 100. The pixel luminance levels of the respective pixels may correspond to the pixel currents flowing in the respective pixels, and therefore the total luminance level of the display panel 100 may correspond to the total current of the display panel 100. Accordingly, use of the total luminance level of the entire display panel 100 may also provide improved voltage drop compensation.

In one or more embodiments, the compensating circuitry 260 is configured to generate, for a pixel of interest, a gain data based on the total current or total luminance level of the display panel 100, and the voltage data correction circuitry 280 is configured to correct the voltage data received from the digital gamma circuitry 250, based on the gain data received from the compensation circuitry 260.

In one or more embodiments, the compensating circuitry 260 is configured to calculate the total current or total luminance level of the display panel 100, based on the image data for the pixels of the display panel 100 and a display brightness value (DBV) specified by the instruction control circuitry 210. The DBV may indicate an overall brightness level of a frame image displayed on the display panel. In one or more embodiments, the DBV may be adjusted based on instructions from the processing device 20. In one or more embodiments, the processing device 20 may be configured to adjust the DBV based on an input to the interface unit 21. In one or more embodiments, the input to the interface unit 21 may be generated based on manipulation of a graphical user interface such as a button and a scroll bar displayed on the display panel 100.

In one or more embodiments, the voltage data correction circuitry 280 is configured to correct the voltage data for the pixel of interest, based on the gain data received from the compensating circuitry 260. In one or more embodiments, the voltage data correction circuitry 280 is configured to supply the corrected voltage data to the data line driving circuitry 240, and the data line driving circuitry 240 is configured to supply drive signals to subpixels of the pixel of interest, based on the corrected voltage data. In one or more embodiments, the data line driving circuitry 240 includes a digital-analog converter (DAC).

In one or more embodiments, the voltage data correction circuitry 280 may comprise a multiplier configured to multiply the voltage data received from the digital gamma circuitry 250 by the gain data received from the compensating circuitry 260. In one or more embodiments, the corrected voltage data may be generated by multiplying values of the voltage data received from the digital gamma circuitry 250 by correction coefficients reflected in the gain data received from the compensating circuitry 260. In such embodiments, the corrected voltage data contributes to the gamma curve being unchanged against the correction of the voltage data.

Figure 3A:
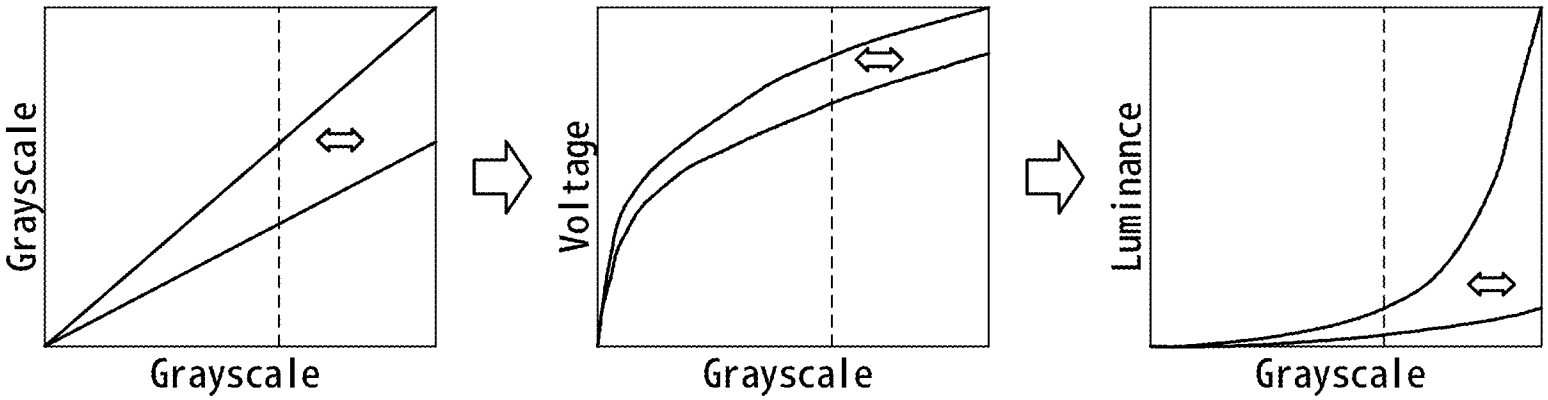
FIG. 3A illustrates a relationship among a grayscale level, voltage, and luminance level, according to one or more embodiments.
Figure 3B:
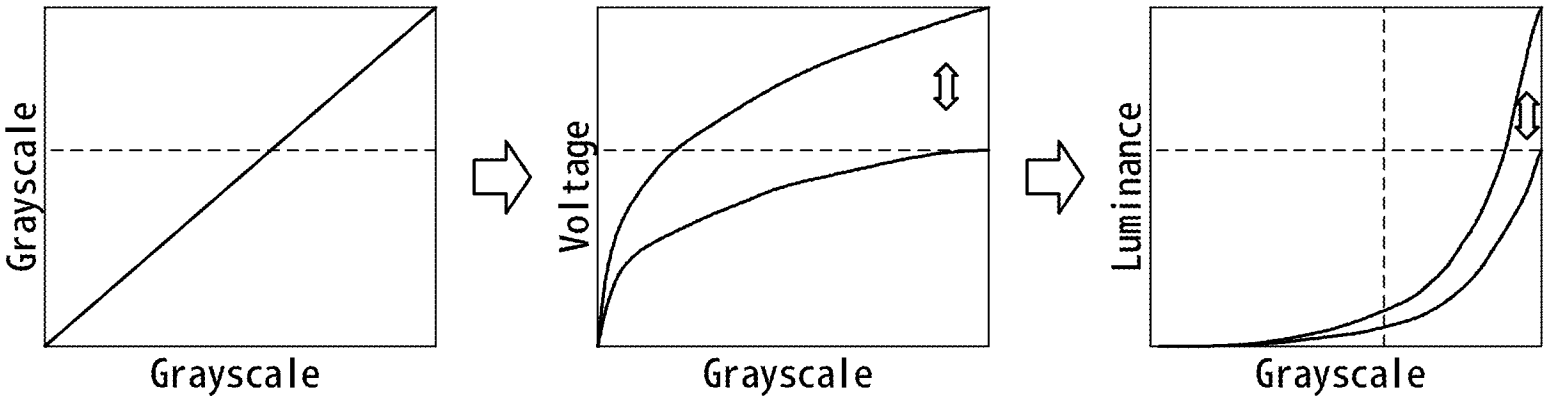
FIG. 3B illustrates a relationship among a grayscale level, voltage, and luminance level, according to one or more embodiments.

When a grayscale value described in an image data is multiplied by a correction coefficient, as illustrated in FIG. 3A, the gamma curve may be modified so that an inflection point of the gamma curve shifts in the right direction, for example, because the luminance level of a subpixel is not proportional to a grayscale value. As illustrated in FIG. 3B, multiplying the voltage data by the gain data may effectively maintain the gamma curve, since the luminance level of a subpixel is proportional to a drive current supplied to the OLED element incorporated in the subpixel, and the drive current is determined by the voltage data.

Figure 4:
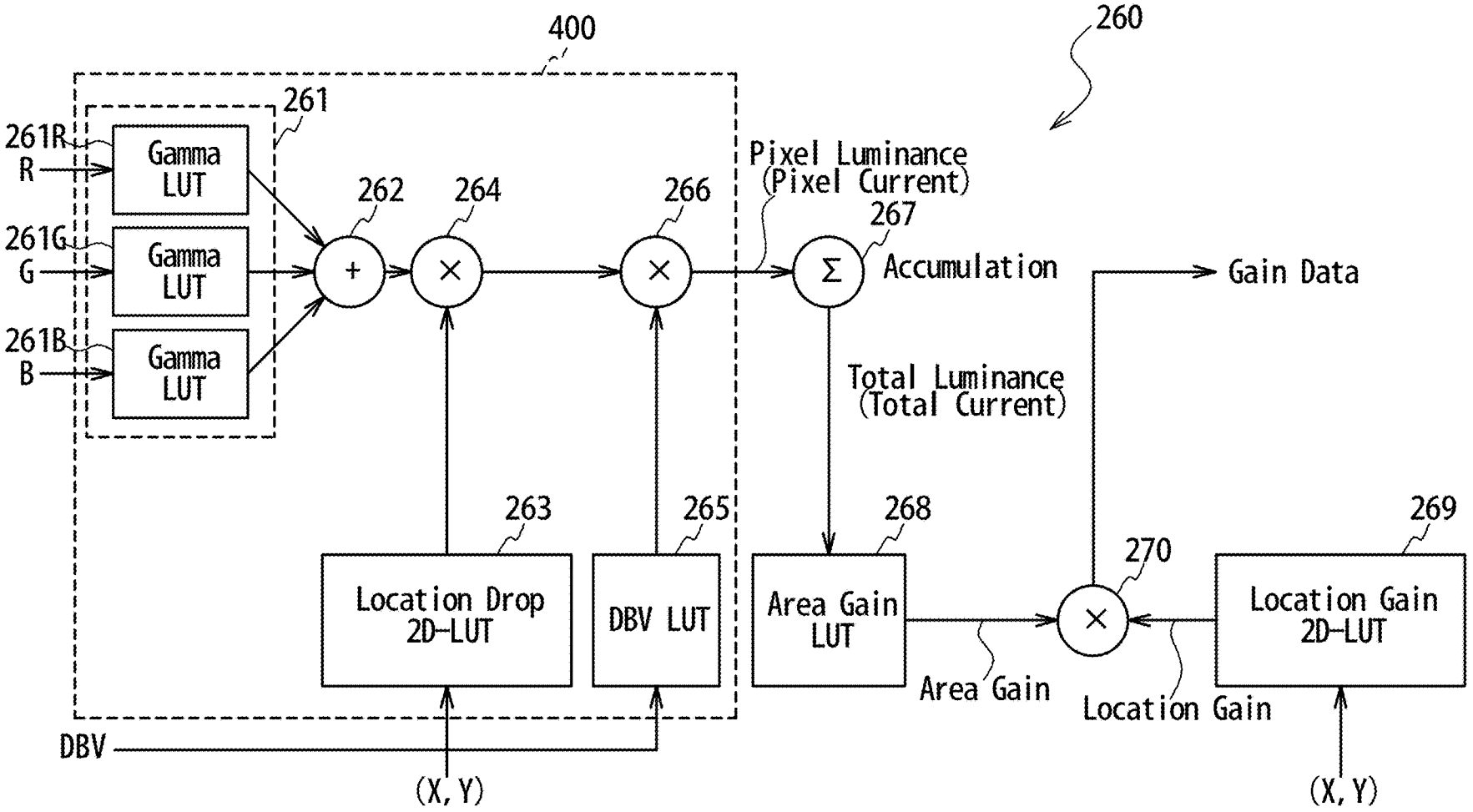
FIG. 4 illustrates an example configuration of compensating circuitry, according to one or more embodiments.

In one or more embodiments, as illustrated in FIG. 4, the compensating circuitry 260 comprises pixel luminance calculation circuitry 400, an integrator 267, area gain lookup table (LUT) circuitry 268, location gain 2D-LUT circuitry 269, and a multiplier 270.

In one or more embodiments, the pixel luminance calculation circuitry 400 is configured to calculate a pixel luminance level of a pixel of interest. In some embodiments, the pixel luminance level corresponds to a pixel current that flows in the pixel, and the pixel luminance level is calculated based on the pixel current. The pixel luminance calculation circuitry 400 may be configured to calculate the pixel current of the pixel of interest.

In one embodiment, when the image data comprises an RGB grayscale data that describes grayscale values of R, G, B subpixels of the pixel of interest, the pixel luminance calculation circuitry 400 may be configured to calculate the pixel luminance level, based on the RGB grayscale data.

In one or more embodiments, the pixel luminance calculation circuitry 400 may comprise gamma LUT circuitry 261, an adder 262, location drop two-dimensional (2D) LUT circuitry 263, a first multiplier 264, DBV LUT circuitry 265, and a second multiplier 266.

In one or more embodiments, the gamma LUT circuitry 261 converts the R, G, and B grayscale values described in the RGB grayscale data for the pixel of interest, into R, G, and B luminance levels, respectively, for a predetermined DBV, for example, an allowed maximum DBV. In one or more embodiments, the gamma LUT circuitry 261 comprises an R gamma LUT 261R, a G gamma LUT 261G, and a B gamma LUT 261B. In one or more embodiments, the R gamma LUT 261R is configured to store luminance levels of the R subpixel respectively corresponding to allowed R grayscale values. Similarly, in one or more embodiments, the G gamma LUT 261G is configured to store luminance levels of the G subpixel respectively corresponding to allowed G grayscale values, and B gamma LUT 261B is configured to store luminance levels of the B subpixel respectively corresponding to allowed B grayscale values. In one or more embodiments, the R, G, and B gamma LUTs 261R, 261G, and 261B are configured to obtain the luminance levels of the R, G, and B subpixels of the pixel of interest, respectively, through a table lookup technique. The obtained luminance levels of the R, G, and B subpixels correspond to subpixel currents that flow in the R, G, and B subpixels of the pixel of interest, respectively, in some embodiments.

In one or more embodiments, the adder 262 is configured to add up the R, G, and B luminance levels to obtain a pixel luminance level of the pixel of interest, for the predetermined DBV (e.g., the maximum DBV). The obtained pixel luminance level corresponds to the pixel current of the pixel of interest for the predetermined DBV, in some embodiments.

In one or more embodiments, the location drop 2D-LUT circuitry 263 is configured to output a first correction coefficient, based on a location of the pixel of interest. The first correction coefficient is used to compensate the voltage drop that occurs with respect to the pixel of interest, depending on the location thereof. In one or more embodiments, the location drop 2D-LUT circuitry 263 is configured to receive coordinates (X, Y) of the pixel of interest from the instruction control circuitry 210 and output the first correction coefficient based on the coordinates (X, Y) of the pixel of interest. In one or more embodiments, the location drop 2D-LUT circuitry 263 is configured to store correction coefficients for various locations of the pixel of interest. In such embodiments, the location drop 2D-LUT circuitry 263 may be configured to select two or more correction coefficients from the stored correction coefficients, based on the coordinates (X, Y) of the pixel of interest and calculate the first correction coefficient to be outputted from the location drop 2D-LUT circuitry 263, through interpolation of the selected correction coefficients based on the coordinates (X, Y).

In one or more embodiments, the DBV LUT circuitry 265 is configured to output a second correction coefficient, based on the DBV specified by the instruction control circuitry 210. In some embodiments, the second correction coefficient is used to calculate the pixel luminance level of the pixel of interest for the specified DBV. In one or more embodiments, the DBV LUT circuitry 265 is configured to store correction coefficients for respective allowed DBVs and select the second correction coefficient from among the stored correction coefficients based on the DBV received from the instruction control circuitry 210.

In one or more embodiments, the first multiplier 264 and the second multiplier 266 are used to calculate the pixel luminance level for the DBV specified by the instruction control circuitry 210, based on the pixel luminance level for the predetermined DBV and the first and second correction coefficients. In one or more embodiments, the first multiplier 264 multiplies the pixel luminance level received from the adder 262 by the first correction coefficient received from the location drop 2D-LUT circuitry 263, and the second multiplier 266 is configured to multiply the output of the first multiplier 264 by the second correction coefficient received from the DBV LUT circuitry 265, to obtain the pixel luminance level for the specified DBV. The obtained pixel luminance level corresponds to the pixel current in the pixel of interest for the specified DBV in some embodiments.

In one or more embodiments, the integrator 267 is configured to integrate or accumulate the pixel luminance levels successively received from the pixel luminance calculation circuitry 400, to calculate the total luminance level for the entire display panel 100.

In one or more embodiments, the area gain LUT circuitry 268 is configured to output an area gain corresponding to the total luminance level calculated by the integrator 267. In some embodiments, the voltage drops over the power lines increase as the total current or total luminance level of the display panel 100 increases. In one embodiment, when the total current of the display panel 100 is large, the area gain may be generated so that the actual luminance levels of the respective pixels of the display panel 100 are maintained against the voltage drops.

In one or more embodiments, the location gain 2D-LUT circuitry 269 is configured to output a location gain based on the location of the pixel of interest to compensate the voltage drop that may occur with respect to the pixel of interest depending on the location of the pixel. In one or more embodiments, the location gain 2D-LUT circuitry 269 is configured to receive coordinates (X, Y) of the pixel of interest from the instruction control circuitry 210 and output the location gain based on the coordinates (X, Y) of the pixel of interest. In one or more embodiments, the location gain 2D-LUT circuitry 269 is configured to store location gains for various locations of pixels. In such embodiments, the location gain 2D-LUT circuitry 269 may be configured to select two or more location gains from the stored location gains, based on the coordinates (X, Y) of the pixel of interest and calculate the location gain to be outputted from the location gain 2D-LUT circuitry 269, through interpolation of the selected location gains based on the coordinates (X, Y).

In one or more embodiments, the multiplier 270 is configured to obtain the gain data based on the area gain and the location gain for the pixel of interest and supply the gain data to the voltage data correction circuitry 280. In some embodiments, the multiplier 270 is configured to multiply the area gain by the location gain to obtain the gain data.

Figure 5:
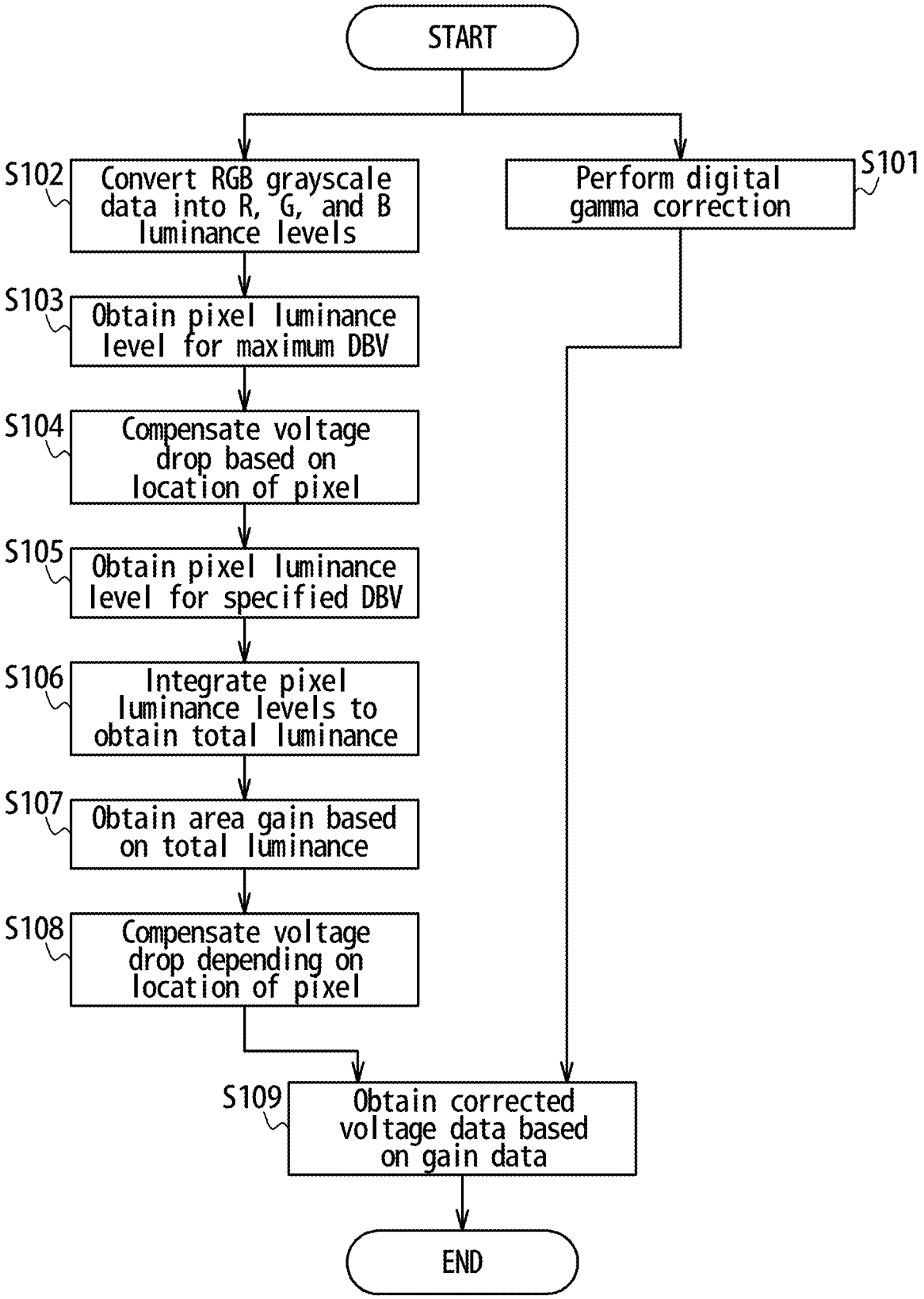
FIG. 5 is a flowchart illustrating an example operation of a display driver, according to one or more embodiments.

In one or more embodiments, the display driver 200 is configured to operate as illustrated in FIG. 5. At step S101, upon reception of the RGB grayscale data for the pixel of interest from the instruction control circuitry 210, the digital gamma circuitry 250 may convert the RGB grayscale data into voltage data and output the voltage data to the voltage data correction circuitry 280. At step S102, upon reception of the RGB grayscale data from the instruction control circuitry 210, the gamma LUT circuitry 261 may output the R, G, and B luminance levels corresponding to the RGB grayscale data. At step S103, the adder 262 may add up the R, G, and B luminance levels to obtain the pixel luminance level for the predetermined DBV. At step S104, to achieve voltage drop compensation based on the location of the pixel of interest, the location drop 2D-LUT circuitry 263 may output the first correction coefficient based on the location of the pixel of interest, and the first multiplier 264 multiplies the pixel luminance level by the first correction coefficient. At step S105, the DBV LUT circuitry 265 may output the second correction coefficient based on the DBV, and the second multiplier 266 may multiply the output of the first multiplier 264 by the second correction coefficient to obtain the pixel luminance level for the specified DBV. Steps S101 to S105 may be repeatedly performed for the respective pixels in the display panel 100. At step S106, the integrator 267 integrates the pixel luminance levels of the respective pixels for the entire display panel 100 to obtain the total luminance level. At step S107, the area gain LUT circuitry 268 may output the area gain corresponding to the total luminance level, and at step S108, the location gain 2D-LUT circuitry 269 may output the location gain based on the location of the pixel of interest. This is followed by multiplying the area gain by the location gain to generate the gain data for the pixel of interest. At step S109, the voltage data correction circuitry 280 may obtain the corrected voltage data by correcting the voltage data received from the digital gamma circuitry 250 based on the gain data received from the compensating circuitry 260. The data line drive circuitry 240 may generate the drive signals based on the corrected voltage data thus generated. In one or more embodiments, the voltage data correction circuitry 280 may multiply the voltage data received from the digital gamma circuitry 250 by the gain data to generate the corrected voltage data.

Figure 6A:
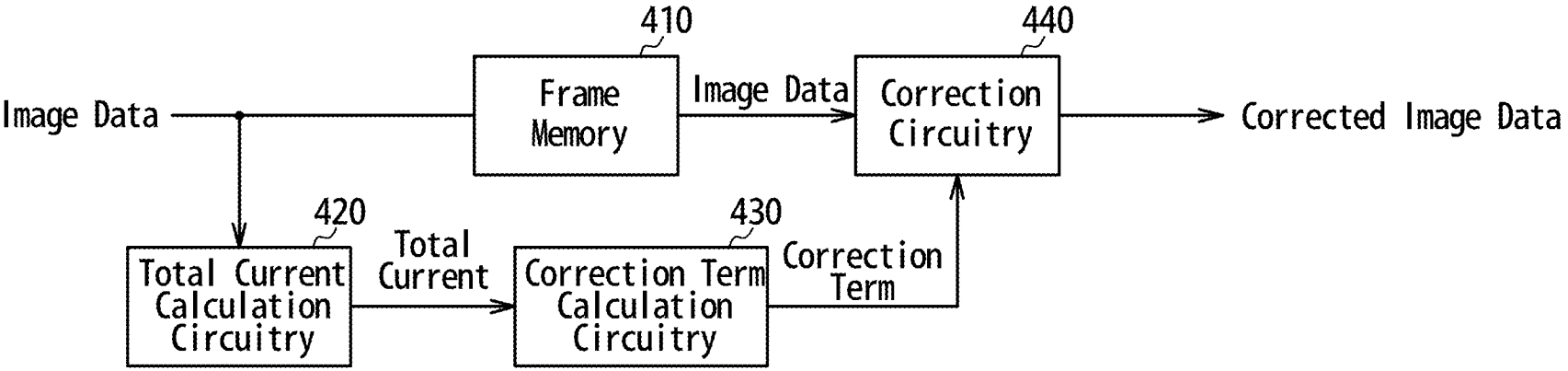
FIG. 6A illustrates an example configuration of a display driver, according to one or more embodiments.

In alternative embodiments, as illustrated in FIG. 6A, the display driver 200 is configured to correct image data and generate the drive signals based on the corrected image data. In such embodiments, the display driver 200 may comprise a frame memory 410, total current calculation circuitry 420, correction term calculation circuitry 430 and correction circuitry 440. In one or more embodiments, the frame memory 410 is configured to store image data for at least one frame image. In one or more embodiments, the total current calculation circuitry 420 is configured to calculate the total current of the display panel 100 for each frame image. In one or more embodiments, the correction term calculation circuitry 430 calculates a correction term based on the total current. In one or more embodiments, the correction circuitry 440 corrects the image data received from the frame memory 410, based on the correction term received from the correction term calculation circuitry 430.

Figure 6B:
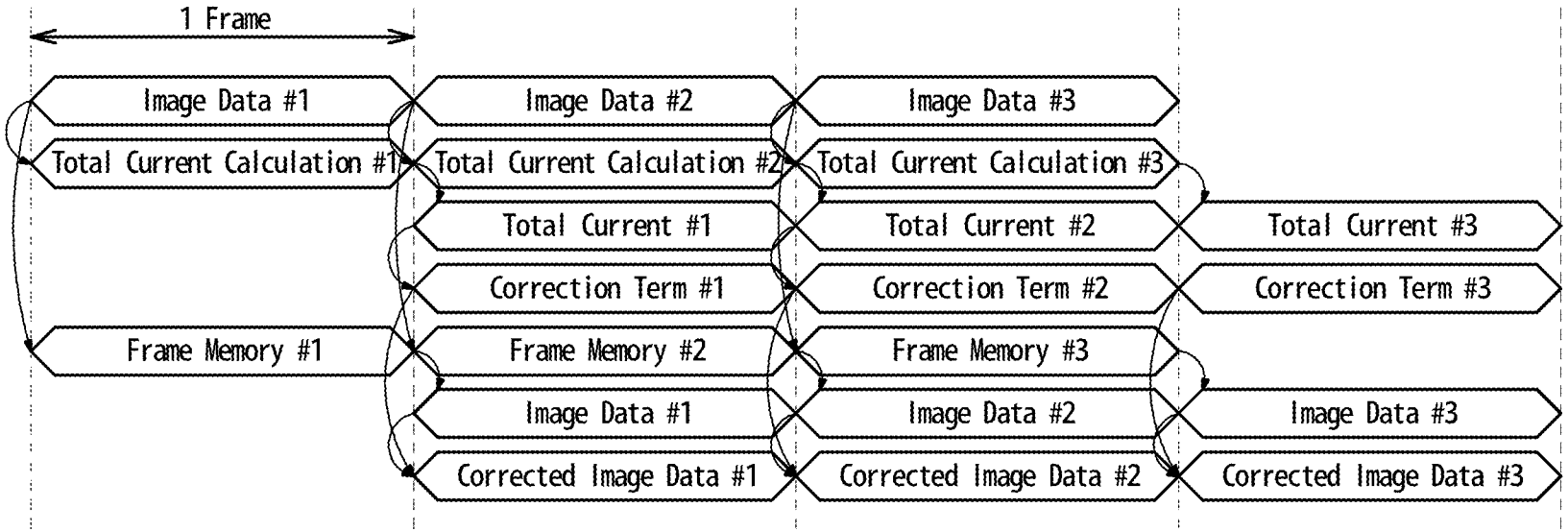
FIG. 6B illustrates an example operation of the display driver illustrated in FIG. 6A, according to one or more embodiments.

In one or more embodiments, the display driver 200 corrects the image data for each frame image, based on the total current calculated based on the image data for the same frame image, as illustrated in FIG. 6B. For example, total current #1 for frame image #1 is calculated from image data #1 for frame image #1, and image data #1 is corrected based on the calculated total current #1 to obtain corrected image data #1. In such embodiments, when the displayed frame image is being updated, the image data for the displayed frame image is corrected based on a total current that is expected to flow in the display panel 100 at the time when the update of the displayed image is completed.

Figure 7:
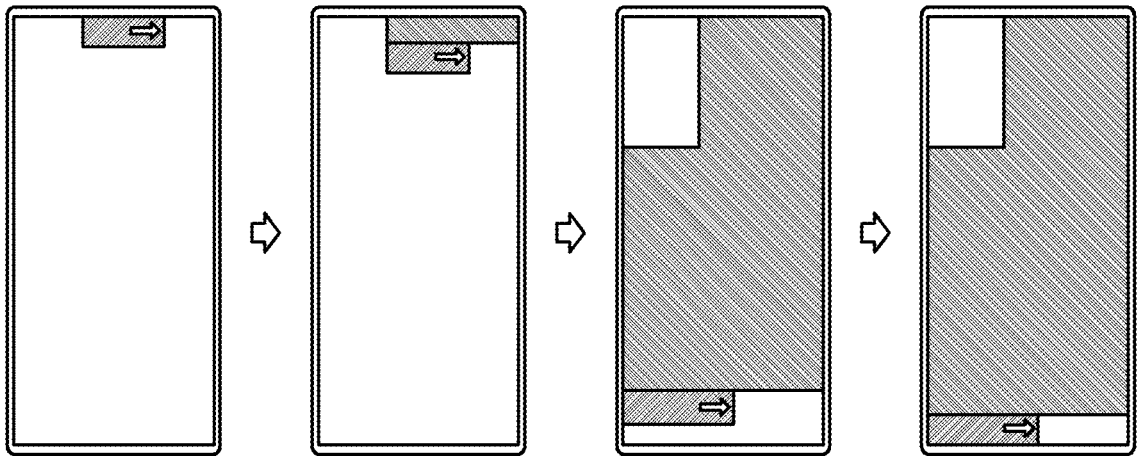
FIG. 7 illustrates an example operation of the display driver illustrated in FIG. 6A, according to one or more embodiments.

In one or more embodiments, as illustrated in FIG. 7, a whole-white image is currently displayed on the display panel 100, and an almost black image in which 1/9 region at the top left is white and the remainder is black is to be displayed next. In such embodiments, the almost black image may be subjected to voltage drop compensation based on the total current obtained for the almost black image. In one embodiment, when the display device 10 is configured to display the image line by line and the 1/9 white portion of the almost black image is being updated, the whole-white image is displayed on the display panel 100 at this moment, and the voltage drop for the whole-white image may occur, despite that the image data for the almost black image is corrected based on the total current calculated for the almost black image.

Figure 8A:
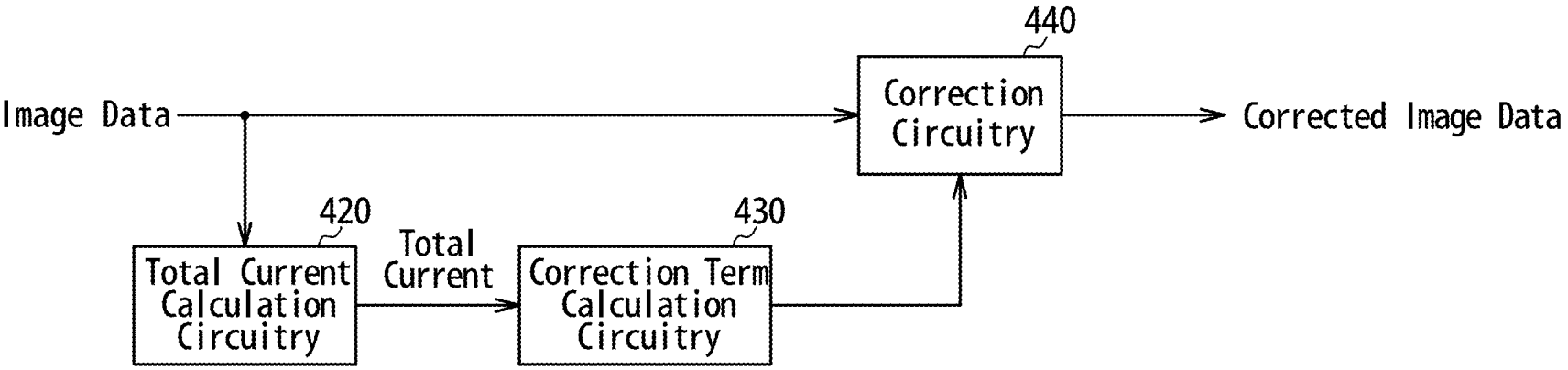
FIG. 8A illustrates an example configuration of a display driver, according to one or more embodiments.
Figure 8B:
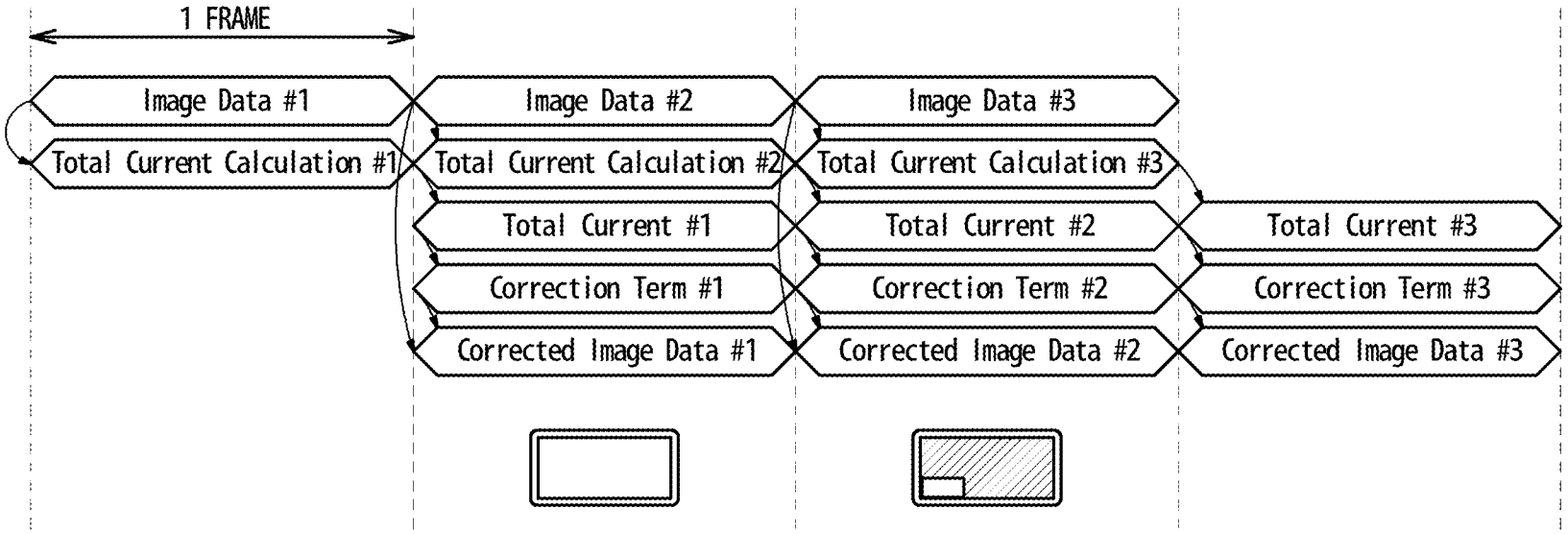
FIG. 8B illustrates an example operation of the display driver illustrated in FIG. 8A, according to one or more embodiments.

In alternative embodiments, as illustrated in FIG. 8A, the display driver 200 may not include the frame memory 410. In such embodiments, the total current calculated for a frame image may be reflected to a next frame image as illustrated in FIG. 8B. Voltage drop compensation may be appropriately performed for a part of the frame image which is updated during a former part of a frame period, since the calculated total current may correspond to a total current flowing in the display panel 100 during the former part.

Figure 9:
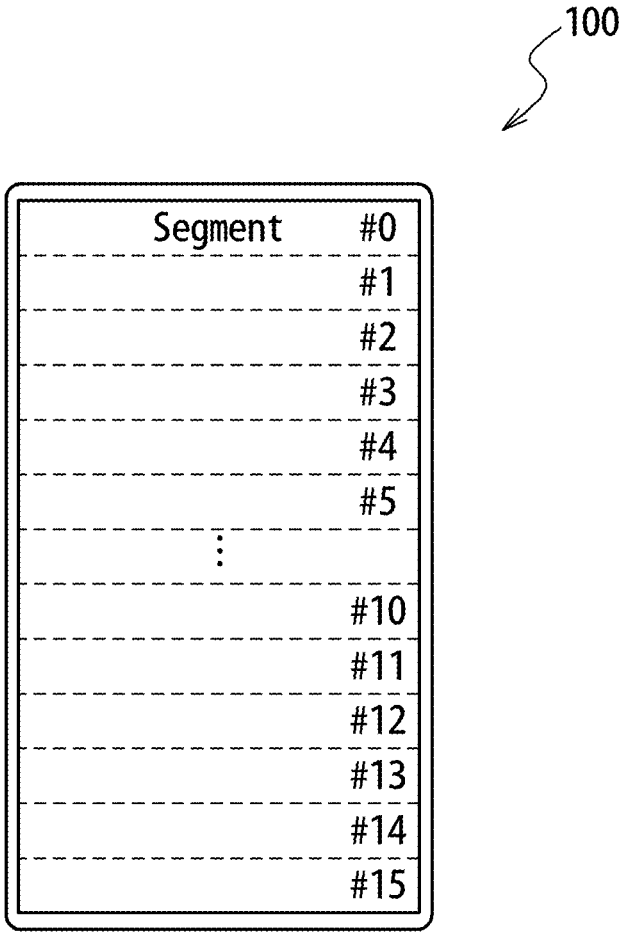
FIG. 9 illustrates an example arrangement of segments in a display panel, according to one or more embodiments.

In one or more embodiments, voltage drop is compensated based on a total current currently flowing in the display panel 100 during updating a frame image. In one or more embodiments, as illustrated in FIG. 9, the display panel 100 is sectioned into a plurality of segments, for example, 16 segments #0 to #15. In one or more embodiments, each segment comprises a plurality of lines of pixels, where a "line" of pixels may mean a row of pixels which are arrayed in a "horizontal" direction of the display panel 100. The "horizontal" direction may mean a direction in which the scan lines of the display panel 100 are extended. In one or more embodiments, the display driver 200 is configured to calculate subtotals of either pixel luminance levels or pixel currents for the respective segments and add the subtotals to obtain total luminance level or total current of the entire display panel 100. In other embodiments, the segments are arrayed in a vertical direction which is perpendicular to the horizontal direction.

Figure 10:
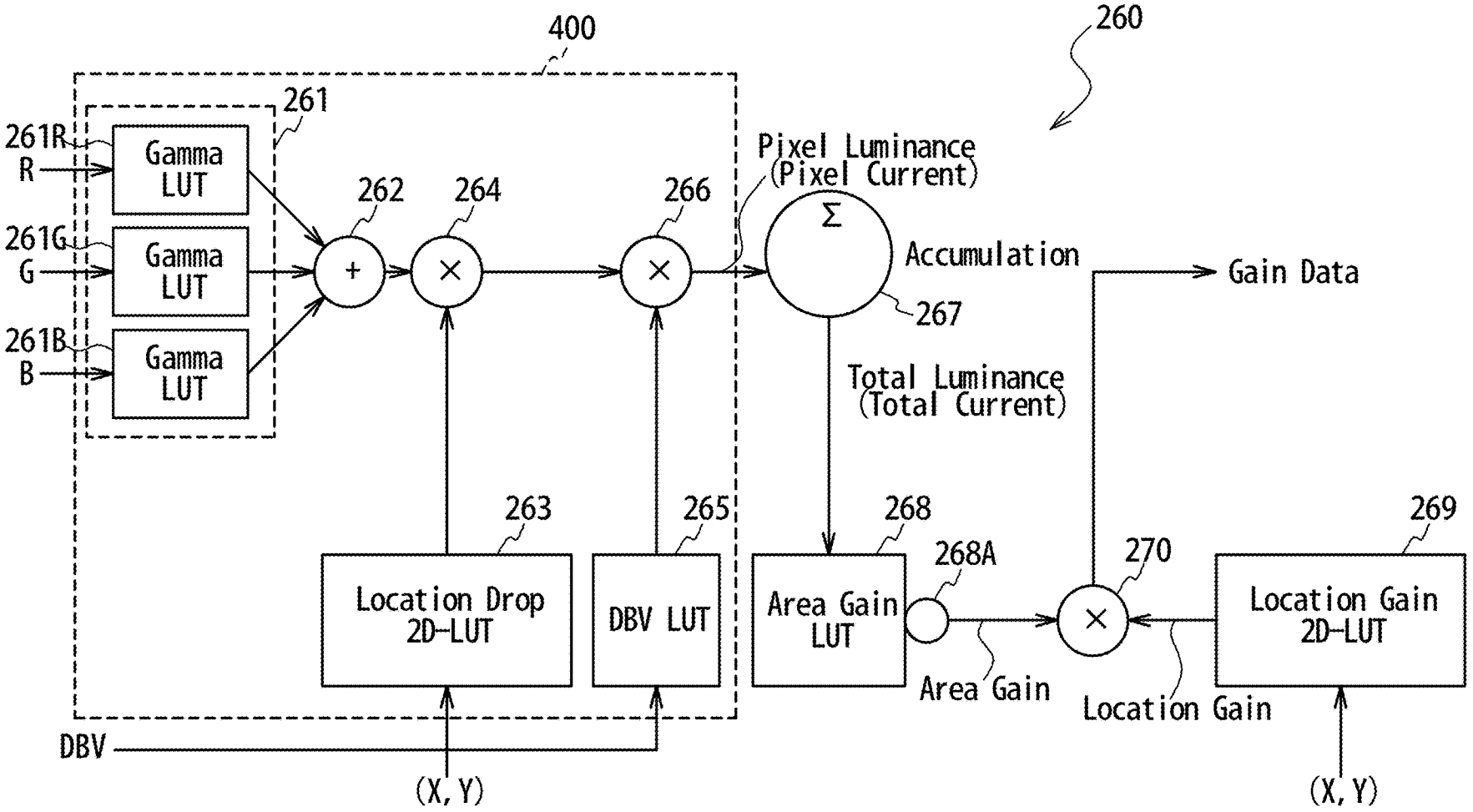
FIG. 10 illustrates an example configuration of compensating circuitry, according to one or more embodiments.

In one or more embodiments, as illustrated in FIG. 10, the integrator 267 is configured to calculate the subtotals of either pixel luminance levels or pixel currents for the respective segments and store the calculated subtotals therein. In such embodiments, the integrator 267 is further configured to add the calculated subtotals to obtain the total luminance level or the total current of the entire display panel 100. When the display panel 100 is sectioned into 16 segments #0 to #15, in one or more embodiments, the subtotal for one segment for which the image is being currently updated is calculated based on an image data for a previous image frame and the subtotals for the remaining 15 segments are calculated based on the image data currently displayed on the display panel 100. As a result, the subtotals for at least 15 segments are correctly calculated.

Figure 11:
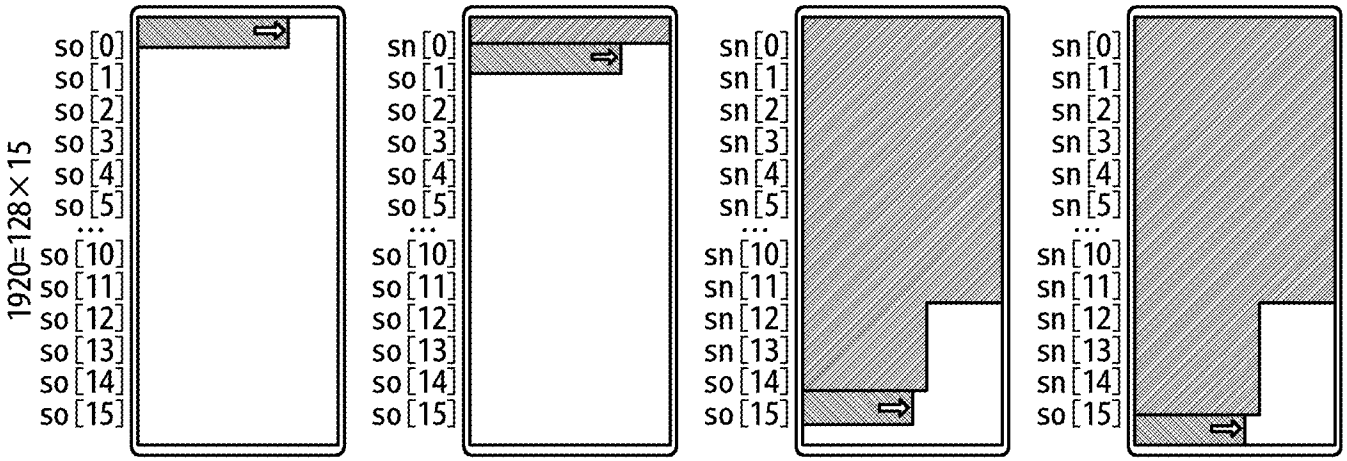
FIG. 11 illustrates an example operation of the compensating circuitry illustrated in FIG. 10, according to one or more embodiments.

Referring to FIG. 11, in one or more embodiments, segments #0 to #15 are successively updated in this order from a first frame image to a second frame image in a current frame period. Legends "so[0]" to "so[15]" respectively denote subtotals of the pixel luminance levels or pixel currents calculated for segments #0 to #15 for the first frame image which is initially displayed on the display panel 100, and legends "sn[0]" to "sn[15]" respectively denote subtotals calculated for segments #0 to #15 for the second frame image which is to be next displayed.

In one or more embodiments, when segment #0 is being updated from the first frame image to the second frame image as illustrated in the leftmost part of FIG. 11, the gain data are calculated for pixels in segment #0, based on the total luminance level or total current calculated as the total of the subtotals so[0]-so[15] calculated for the first frame image, as is represented by the following expression (1):

$$\text{sum} = \sum_{i=0}^{15} so[i], \tag{1}$$

where "sum" in expression (1) is the total luminance level or the total current for the entire display panel 100.

When segment #i is being updated for i being an integer from 1 to 15, in one or more embodiments, the gain data are calculated for pixels in segment #i, based on the total luminance level or total current calculated as the total of the subtotal(s) sn[0] to sn[i−1] calculated for the second frame image and the subtotal(s) so[i]-so[15] calculated for the first frame image, as is represented by the following expression (2):

$$\text{sum} = \left(\sum_{i=0}^{i-1} sn[i] + \sum_{i=i}^{15} so[i]\right). \tag{2}$$

For example, in one or more embodiments, when segment #1 is being updated, since segment #0 has already been updated, the gain data are calculated for pixels in segment #1, based on the total luminance level or total current calculated as the total of the subtotal sn[0] calculated for the second frame image and the subtotals so[1]-so[15] calculated for the first frame image, as is represented by the following expression (3):

$$\text{sum} = \left(\sum_{i=0}^{0} sn[i] + \sum_{i=1}^{15} so[i]\right). \tag{3}$$

In one or more embodiments, when segment #14 is being updated, since segments #0 to #13 have already been updated, the gain data are calculated for pixels in segment #14, based on the total luminance level or total current calculated as the total of the subtotals sn[0] to sn[13] calculated for the second frame image and the subtotals so[14]-so[15] calculated for the first frame image, as is represented the following expression (4):

$$\text{sum} = \left(\sum_{i=0}^{13} sn[i] + \sum_{i=14}^{15} so[i]\right). \tag{4}$$

In one or more embodiments, when segment #15 is being finally updated, since segments #0 to #14 have already been updated, the gain data are calculated for pixels in segment #15, based on the total luminance level or total current calculated as the total of the subtotals sn[0] to sn[14] calculated for the second frame image and the subtotal so[15] calculated for the first frame image, as is represented the following expression (5):

$$\text{sum} = \left(\sum_{i=0}^{14} sn[i] + \sum_{i=15}^{15} so[i]\right). \tag{5}$$

This scheme achieves calculating the total luminance level or total current based on the subtotals of the pixel luminance levels or pixel currents corresponding to the actually-displayed image for at least 15 of the 16 segments, and this may offer proper voltage drop compensation. If there is no significant change in the image of the remaining one segment, the total luminance level or total current is substantially properly calculated. This may imply the gain data is calculated based on at least 15 reliable subtotals. In one or more embodiments, a relative error of the calculated gain data is reduced to 6.25% (1/16) at most.

Figure 12:
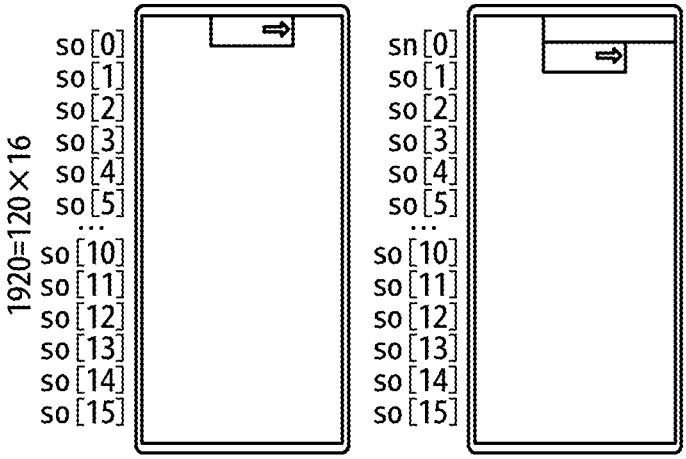
FIG. 12 illustrates an example operation of the compensating circuitry illustrated in FIG. 10, according to one or more embodiments.

To suppress abrupt changes in the area gain between adjacent segments, in one or more embodiments, the compensating circuitry 260 further comprises an interpolation calculator 268A configured to provide interpolation processing for the area gain calculated by the area gain LUT circuitry 268. In one or more embodiments, the interpolation calculator 268A is configured to perform interpolation of a current area gain and a previous area gain to obtain the area gain finally used to obtain the gain data. The current area gain may be the area gain obtained by the area gain LUT circuitry 268 for a segment which is currently being updated, and the previous area gain may be the area gain obtained for a previous segment which has been just updated. For example, when segment #1 is being updated as illustrated in FIG. 12, the current area gain may be calculated for segment #1 based on sn[0] and so[1] to so[15], and the previous area gain may have been calculated for segment #0 based on so[0]-so[15]. The previous area gain and the current area gain may have different values from each other in many cases except for the case when a still image is displayed. In one embodiment, when the difference between the previous area gain and the current area gain is large, the brightness difference between segments #0 and #1 may be large, resulting in displaying an inappropriate frame image. The interpolation of the current area gain and the previous area gain achieves smoothly changing the area gain used to calculate the gain data.

In one or more embodiments, when each segment comprises M lines of pixels, the interpolation calculator 268A is configured to calculate an interpolated area gain for pixels positioned in the j-th line of a segment which is being updated, in accordance with the following expression (6):

$$K_{AREA}=\{K_{AREA_P}\times(M-j)+K_{AREA_C}\times j\}/M, \quad (6)$$

where $K_{AREA}$ is the interpolated area gain finally used to calculate the gain data, $K_{AREA_P}$ is the previous area gain, and $K_{AREA_C}$ is the current area gain.

In one or more embodiments, the display panel 100 comprises 1920 lines of pixels and 16 segments are defined in the display panel 100. In such an embodiment, each segment comprises 120 lines of pixels, and the interpolation calculator 268A may calculate the interpolated area gain in accordance with the following expression (7):

$$K_{AREA}=\{K_{AREA_P}\times(120-j)+K_{AREA_C}\times j\}/120. \quad (7)$$

Figure 13:
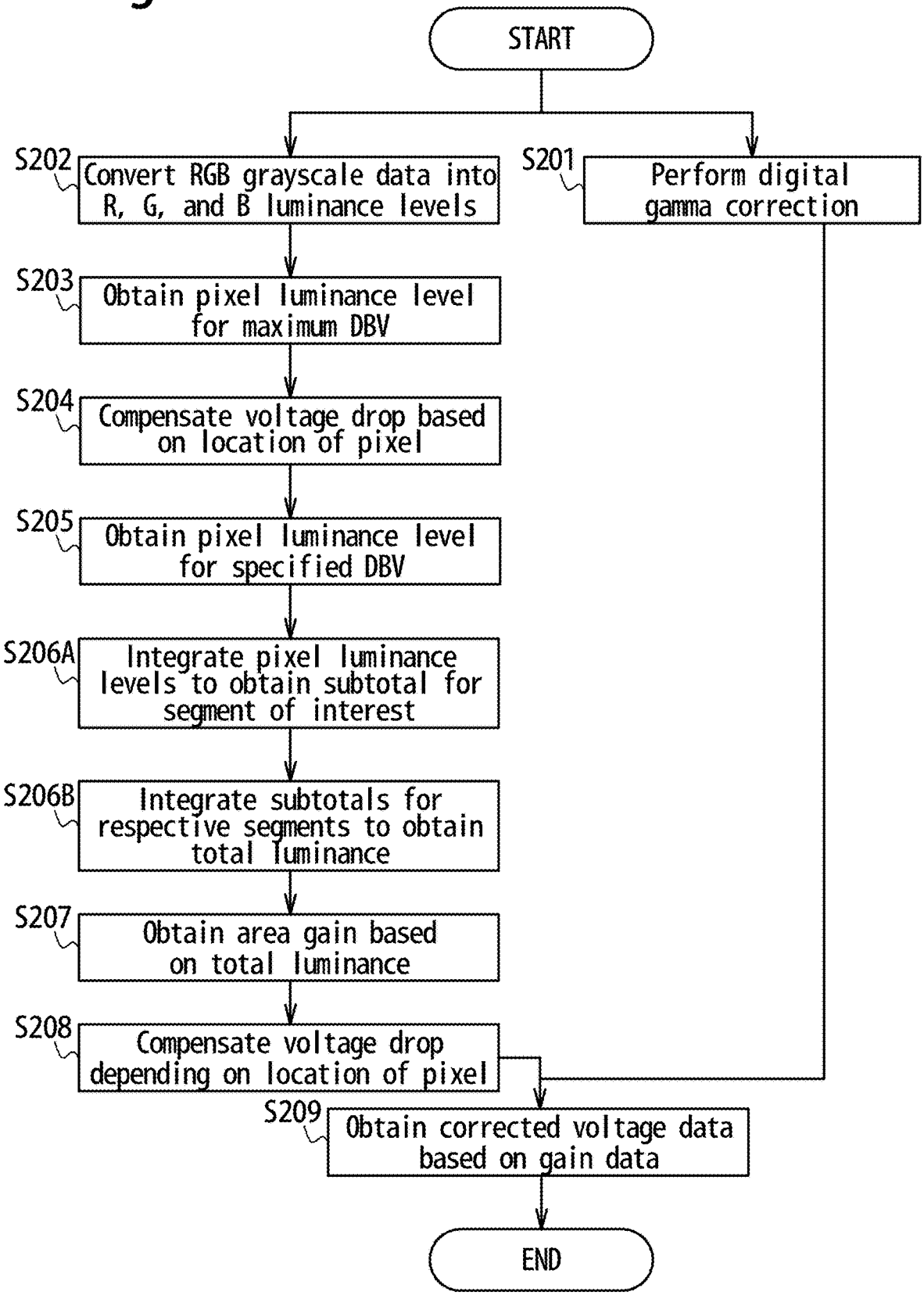
FIG. 13 is a flowchart illustrating an example operation of a display driver, according to one or more embodiments.

In one or more embodiments, the display driver 200 is configured to operate as illustrated in FIG. 13. At steps S201 to S205, similar processes to those of steps S101 to S105 in FIG. 5 are performed. At step S206A, the integrator 267 may integrate the pixel luminance levels or pixel currents for a segment which is being updated, to obtain the subtotal of the pixel luminance levels for the segment. At step S206B, the integrator 267 may then obtain the total luminance level or total current used for calculating the area gain, in accordance with the above-described expressions (1) and (2). At steps S207 to S209, similar processes to those of steps S107 to S109 in FIG. 5 are performed.

In such an embodiment, voltage drop compensation is achieved without using a frame memory. When the number of segments is N, for at least N−1 of the N segments, the subtotals of the pixel luminance levels or pixel currents are calculated based on the currently-displayed frame image on the display panel 100, and this may achieve proper voltage drop compensation. In other words, the relative error of the area gain may be reduced to 1/N×100% at most.

Figure 14:
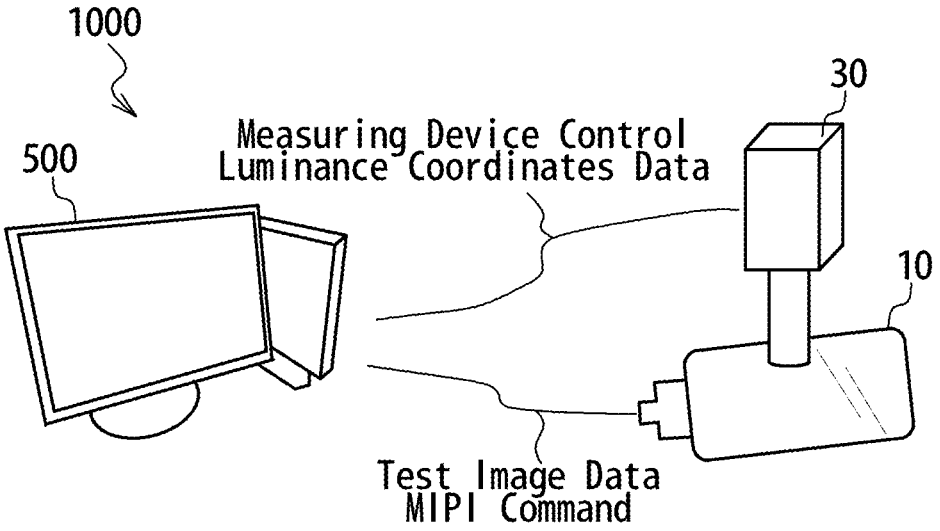
FIG. 14 illustrates an example test system, according to one or more embodiments.

In one or more embodiments, as illustrated in FIG. 14, the display device 10 is tested by a test system 1000 comprising a processing device such as a personal computer (PC) 500 and a measuring device 30 such as a luminance meter. In one or more embodiments, the test system 1000 is configured to test the display device 10 and adjust parameter settings of the display driver 200 during a shipping inspection.

In one or more embodiments, the PC 500 is configured to, when testing the display device 10, transmit test image data and MIPI commands to the display driver 200 of the display device 10. In one or more embodiments, the display driver 200 is configured to display test images based on the test image data and the MIPI commands. In one or more embodiments, the PC 500 is configured to control the measuring device 30 to measure luminance coordinates at desired locations of the test images displayed on the display panel 100. In one or more embodiments, the PC 500 is configured to receive the measured luminance coordinates from the measuring device 30 and adjust parameter settings of the display driver 200 based on the measured luminance coordinates.

In this architecture, a large amount of test image data may be transferred to the display driver 200 during the test. To avoid this, the test image data may be compressed to reduce the data transfer amount before being transferred. This may however result in unsuccessful test of the display device 10 due to a compression error of the test image data.

Figure 15A:
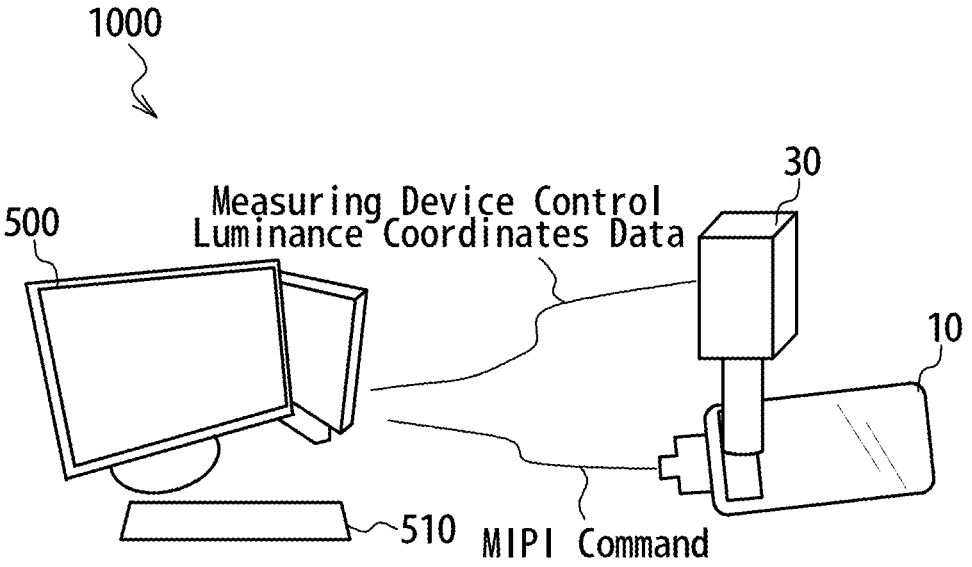
FIGS. 15A and 15B illustrate an example test system, according to one or more embodiments.
Figure 15B:
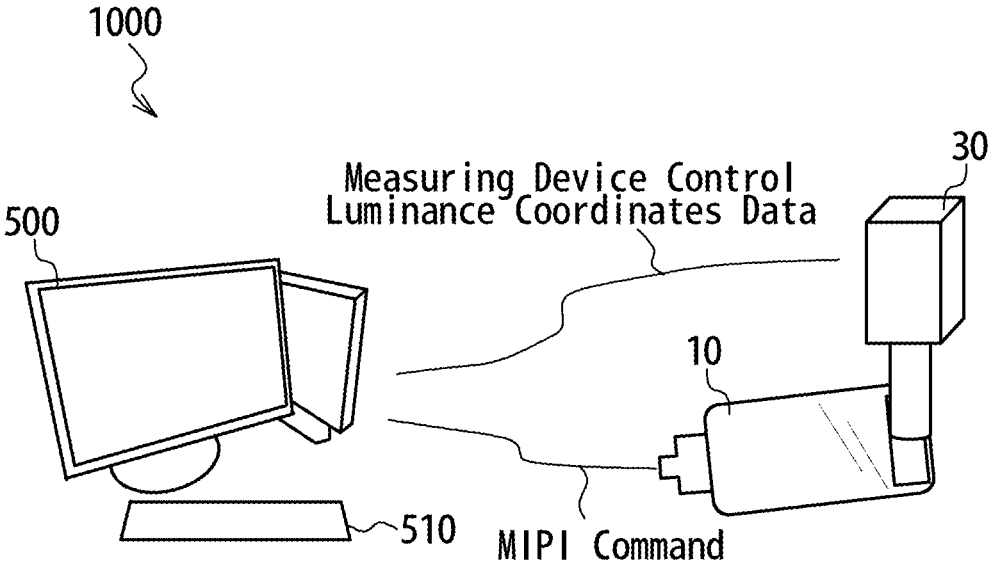

In one or more embodiments, as illustrated in FIGS. 15A and 15B, the display driver 200 is configured to display test images without receiving test image data from the PC 500. In one or more embodiments, the displayed test images comprise those for compensating voltage drops over the power lines in the display panel 100. To precisely measure luminance variations caused by the voltage drops in the display panel 100, the test images may comprise front image elements of different areas, sizes, colors, and grayscale levels, which may be located at different locations in the test images. In one or more embodiments, the measuring device 30 is configured to measure the luminance level of a desired position of the display panel 100 when a test image is displayed. The measuring device 30 changes positions on the display panel 100 between FIG. 15A and FIG. 15B.

Figure 16:
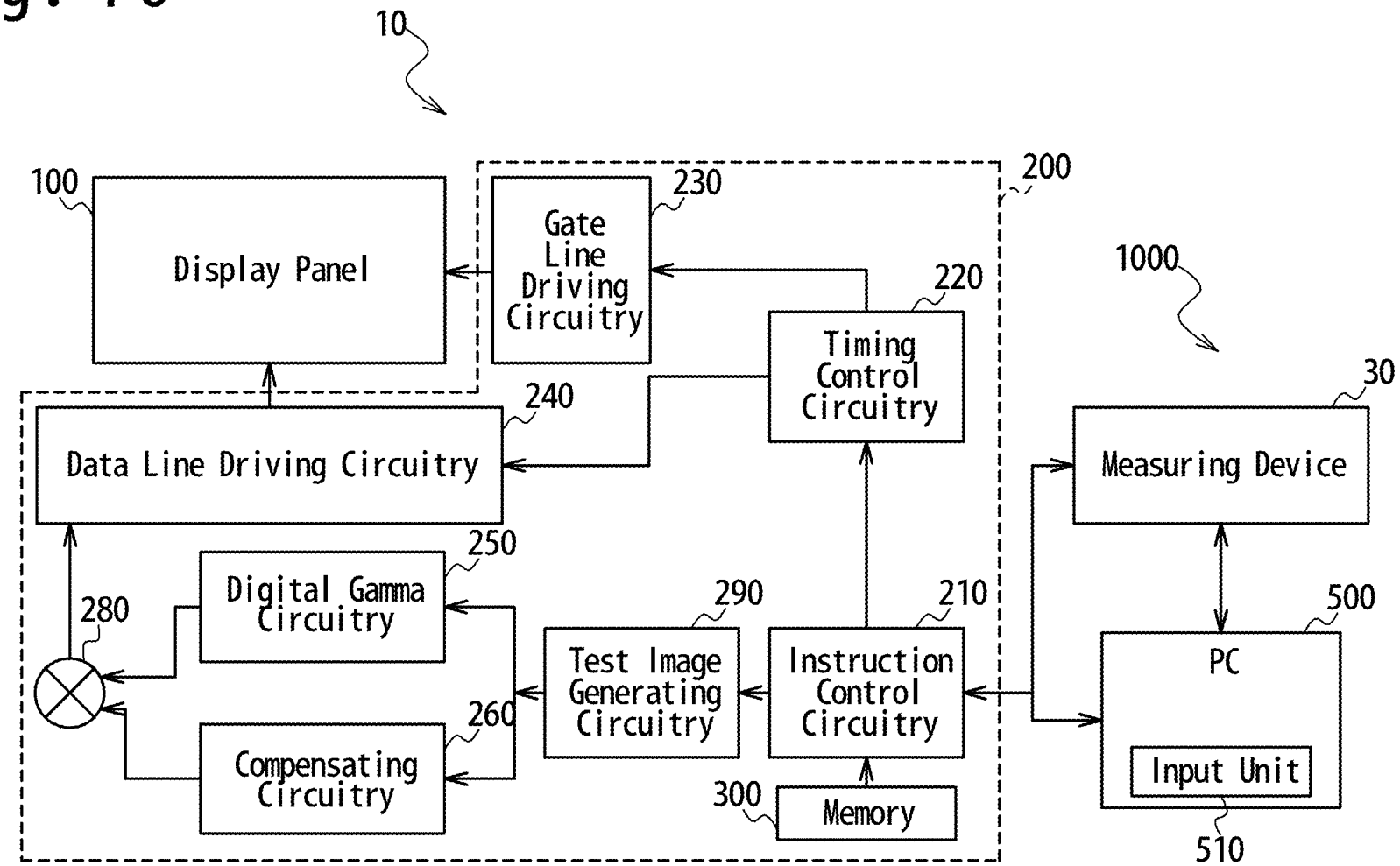
FIG. 16 illustrates an example configuration of a display driver, according to one or more embodiments.

In one or more embodiments, as illustrated in FIG. 16, the display driver 200 further comprises test image generating circuitry 290 and a memory 300. In one or more embodiments, the test image generating circuitry 290 is configured to generate various test images upon reception of commands transmitted from the PC 500 via the instruction control circuitry 210. In one or more embodiments, the memory 300 is connected to the instruction control circuitry 210 and configured to store various parameters.

In one or more embodiments, the PC 500 comprises an input unit 510 configured to receive a user input. In one or more embodiments, a user can specify colors, sizes, and/or coordinates of front image elements incorporated in test images with the user input. In one or more embodiments, the measuring device 30 is configured to measure characteristics of the test images displayed on the display panel 100 and output the measurement results to the PC 500. The measuring device 30 may include a luminance meter configured to measure luminance levels at various locations of the test images displayed on the display panel 100.

Figure 17:
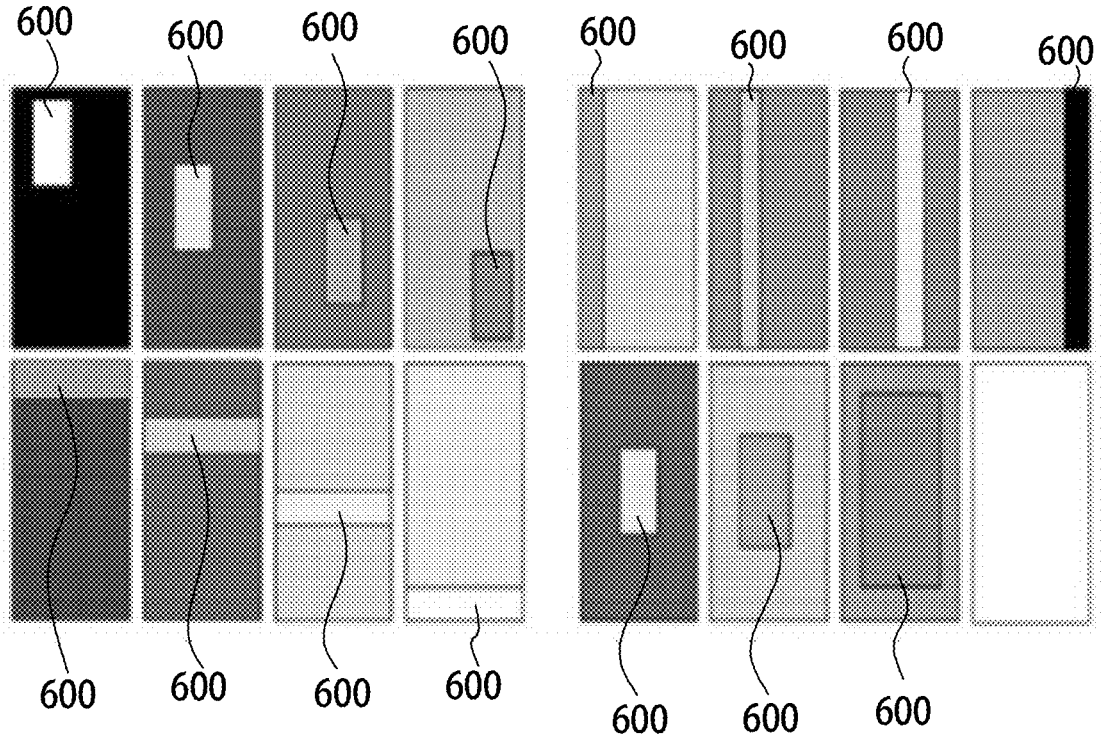
FIG. 17 illustrates example test images, according to one or more embodiments.

FIG. 17 illustrates example test images used for the voltage drop compensation. To precisely compensate the voltage drops in the display panel 100, in one or more embodiments, the test image generating circuitry 290 is configured to generate test images comprising single-colored front image elements of various sizes at various locations in a background. The front image elements are denoted by numerals 600 in FIG. 17. In one or more embodiments, the front image elements 600 in the test images are rectangular.

Figure 18:
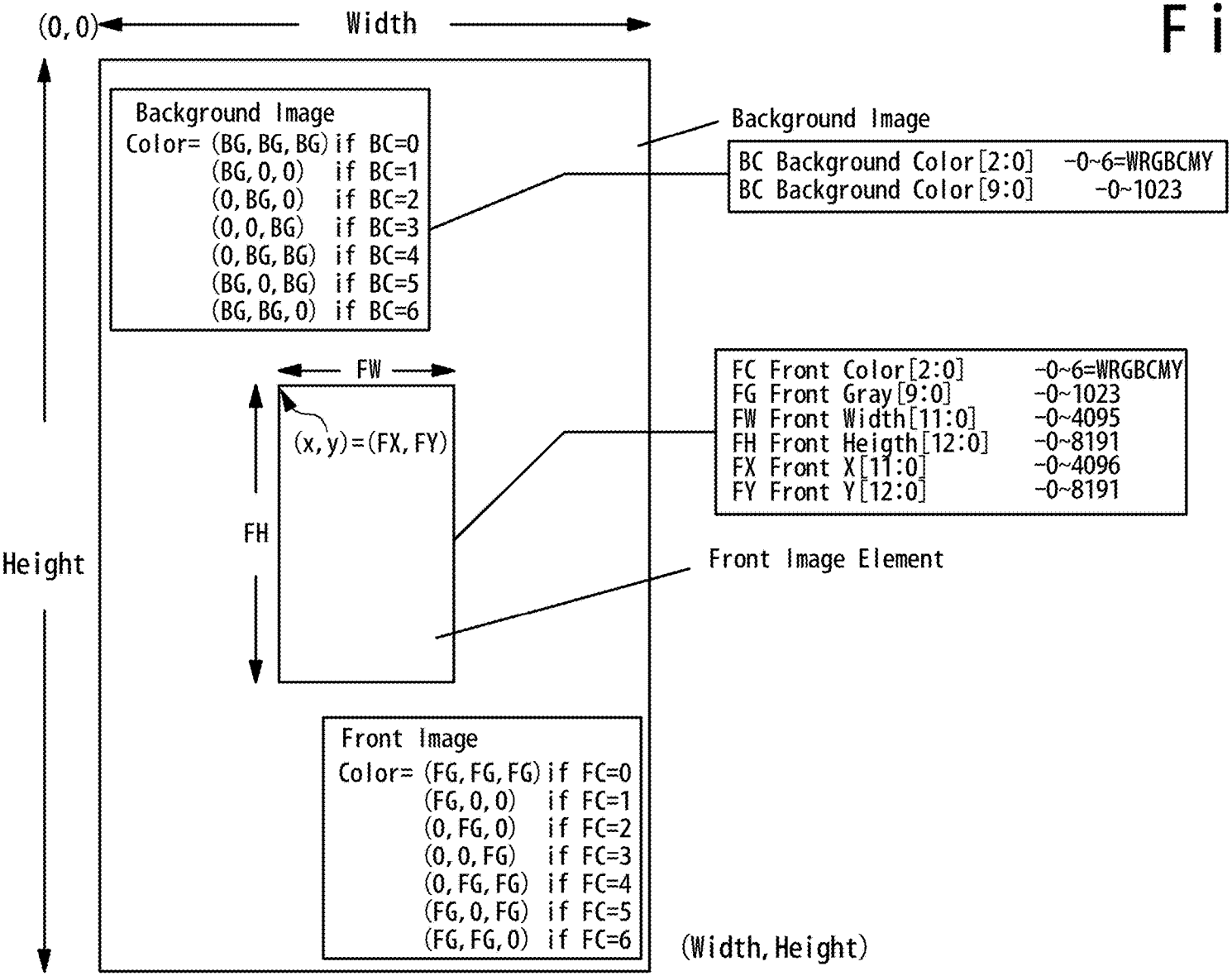
FIG. 18 illustrates example specifications of a text image, according to one or more embodiments.

FIG. 18 illustrates an example specification of a test image generated by the test image generating circuitry 290, according to one or more embodiments. In one or more embodiments, the test image generating circuitry 290 are configured to generate a test image based on at least one of: (1) parameters for specifying a background color and/or grayscale level; (2) parameters for specifying coordinates (FX, FY) of an upper left corner of an front image element incorporated in a test image; (3) parameters for specifying a width and/or vertical size of the front image element; and (4) parameters for specifying a color and/or grayscale level of the front image element. In one or more embodiments, these parameters are generated by the PC 500 and transmitted from the PC 500 to the instruction control circuitry 210 with MIPI commands.

Figure 19:
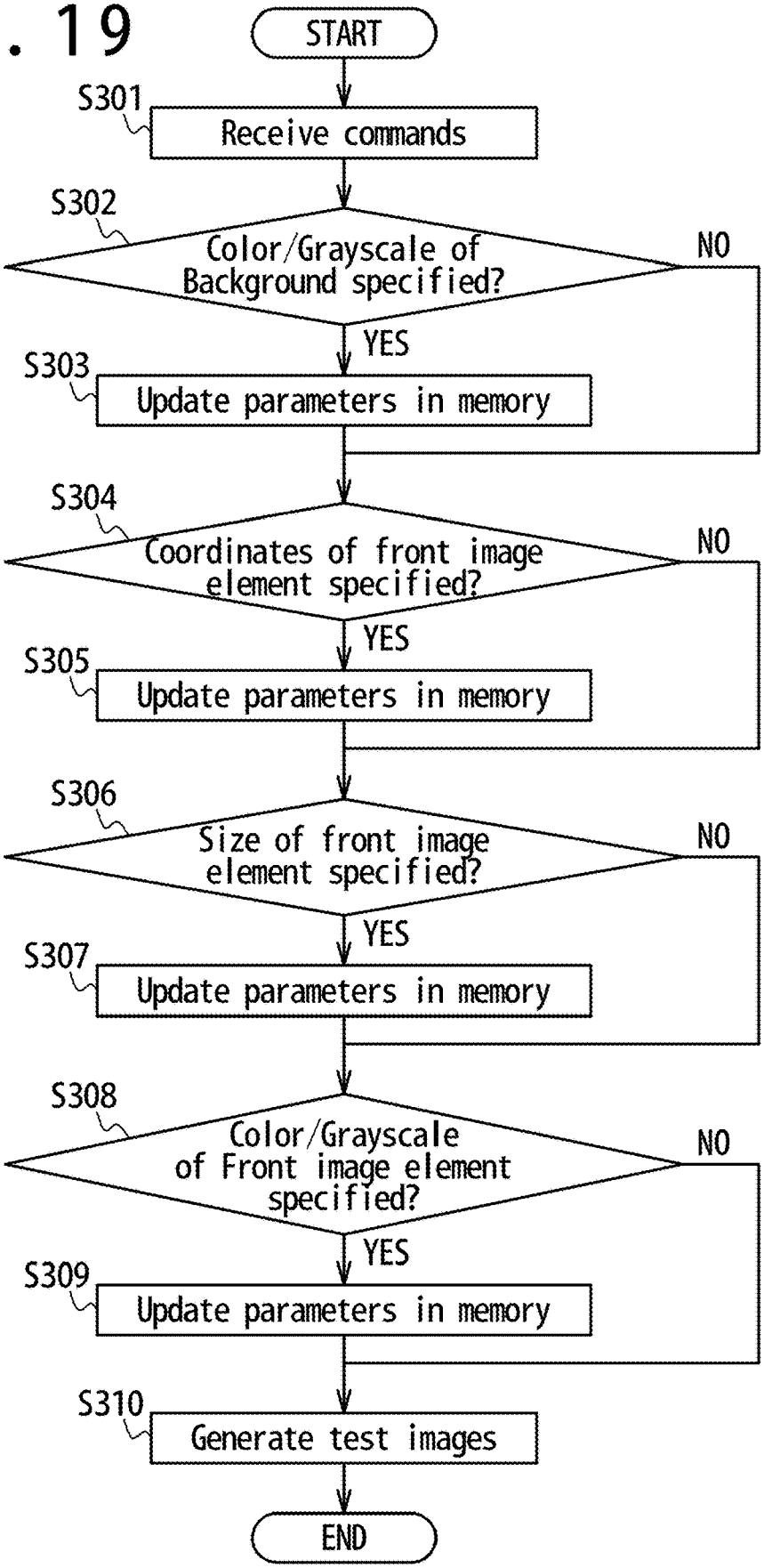
FIG. 19 is a flowchart illustrating an example process of generating test images, according to one or more embodiments.

In one or more embodiments, test images are generated in a process illustrated in FIG. 19. In one or more embodiments, the instruction control circuitry 210 receives commands from the PC 500 at step S301. In one or more embodiments, at step S302, the instruction control circuitry 210 determines whether the commands specify the colors and/or grayscales of the backgrounds of the test images. When the commands specify the colors and/or grayscale levels of the backgrounds, in one or more embodiments, the instruction control circuitry 210 updates the parameters specifying the colors and/or grayscales of the backgrounds in the memory 300 as specified by the received commands at step S303. Otherwise, the process proceeds to step S304. In one or more embodiments, at step S304, the instruction control circuitry 210 determines whether the commands specify the coordinates of the upper left corners of the front image elements of the test images. When the commands specify the coordinates of the upper left corners of the front image elements, in one or more embodiments, the instruction control circuitry 210 updates the parameters specifying the coordinates of the upper left corners of the front image elements in the memory 300 at step S305. Otherwise, the process proceeds to step S306.

In one or more embodiments, at step S306, the instruction control circuitry 210 determines whether the commands specify the widths and/or vertical sizes of the front image elements of the test images. When the commands specify the widths and/or vertical sizes of the front image elements, in one or more embodiments, the instruction control circuitry 210 updates the parameters specifying the width and/or vertical size of the front images in the memory 300 at step S307. Otherwise, the process proceeds to step S308. At step S308, in one or more embodiments, the instruction control circuitry 210 determines whether the commands specify the colors and/or grayscales of the front image elements of the test images. When the commands specify the colors and/or grayscales of the front image elements, in one or more embodiments, the instruction control circuitry 210 updates the parameters specifying the colors and/or grayscales of the front image elements in the memory 300 at step S309. Otherwise, the process proceeds to step S310. The execution order of steps S302-S303, steps S304-S305, steps S306-S307, and steps S308-S309 is not particularly limited. For example, the instruction control circuitry 210 may execute steps S308-S309, step S306-S307, steps S304-S305, and steps S302-S303 in this order.

At step S310, in one or more embodiments, the instruction control circuitry 210 activates the test image generating circuitry 290, and the test image generating circuitry 290 generates various test images based on the parameters stored in the memory 300.

Figure 20A:
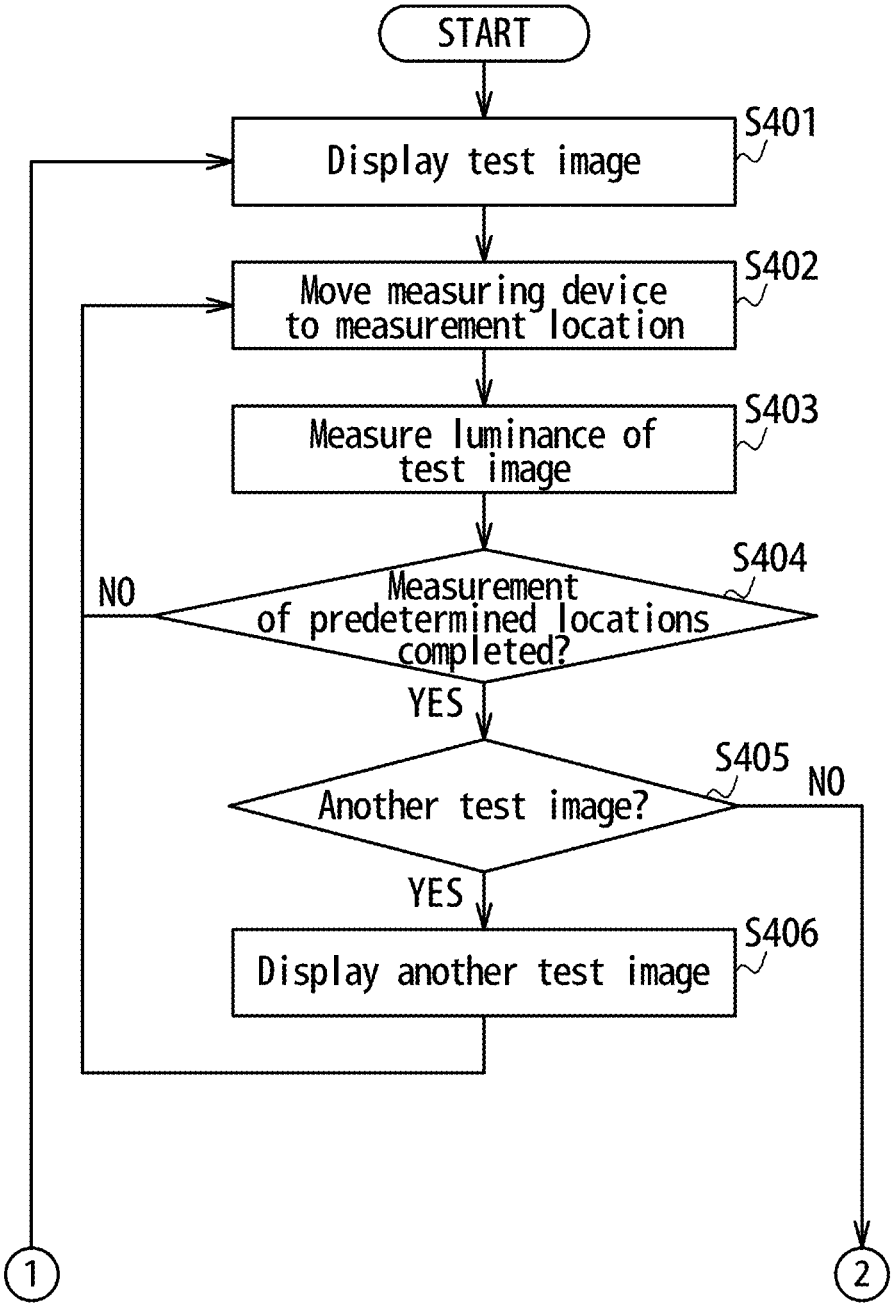
FIGS. 20A and 20B illustrate an example process of a test of a display device, according to one or more embodiments.
Figure 20B:
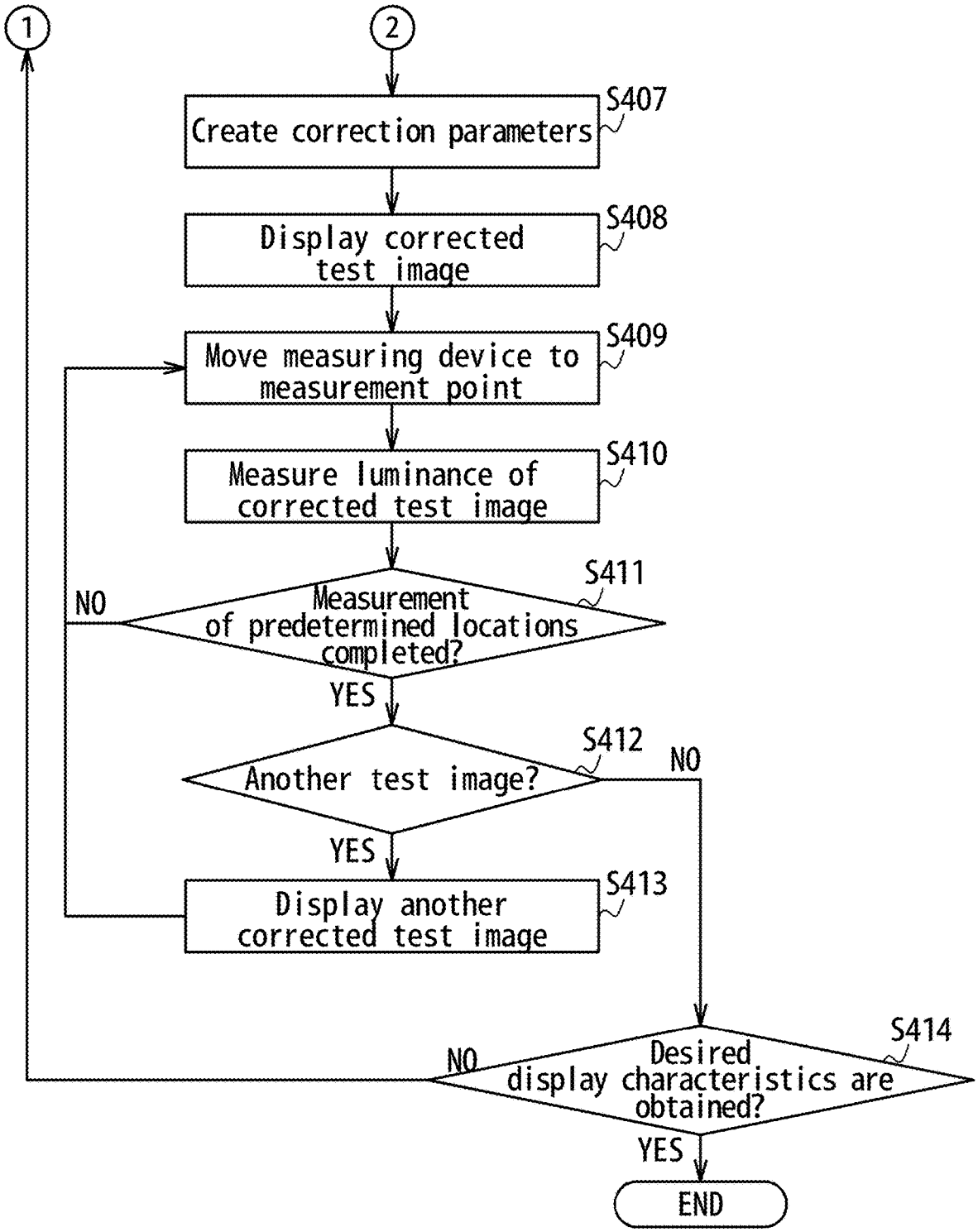

In one or more embodiments, the display device 10 is tested by the test system 1000 in a process illustrated in FIGS. 20A and 20B. At step S401, in one or more embodiments, a test image is displayed on the display panel 100 under control of the PC 500. At step S402, in one or more embodiments, the measuring device 30 is moved to a desired measurement location on the test image by a manipulator (not illustrated). The manipulator may be programmed to allow the measuring device 30 to measure luminance levels at desired locations and/or at desired timing. Alternatively, the PC 500 may control the manipulator according to a program stored in the PC 500. In alternative embodiments, the display panel 100 may be moved with respect to the measuring device 30. At step S403, in one or more embodiments, the measuring device 30 measures a luminance level of the desired location of the test image, and the PC 500 obtains the measurement result from the measuring device 30. At step S404, in one or more embodiments, the PC 500 determines whether measurement of predetermined locations of the test image has been completed.

When the measurement of the predetermined locations has been completed, the process proceeds to step S405. Otherwise, the process returns to step S402. At step S405, in one or more embodiments, the PC 500 determines whether luminance measurement is to be performed for a different test image, based on the user's input from the input unit 510 or saved data in an ROM.

If so, in one or more embodiments, the test image generating circuitry 290 generates another test image to display the generated test image on the display panel 100 at step S406. In one or more embodiments, the processes of steps S402-S405 are repeated for the generated test image. When luminance measurement of desired test images has been completed, the process proceeds to step S407 in FIG. 20B. At step S407, in one or more embodiments, the PC 500 creates appropriate correction parameters to be set to the compensating circuitry 260, based on the measurement results and sends the correction parameters to the instruction control circuitry 210 with MIPI commands. In one or more embodiments, the correction parameters comprises first correction coefficients to be stored in the location drop 2D-LUT circuitry 263 and/or location gains to be stored in the location gain 2D-LUT circuitry 269. The correction parameters are then set to the compensating circuitry 260 to allow the compensating circuitry 260 to generate the gain data based on the correction parameters for voltage drop compensation.

At step S408, in one or more embodiments, a corrected test image is displayed on the display panel 100. In one or more embodiments, the corrected test image is generated by performing the gamma correction on a test image data for a test image by the digital gamma circuitry 250 and further correcting the gamma-corrected image data by the voltage data correction circuitry 280 based on the gain data generated by the compensating circuitry 260.

In one or more embodiments, processes similar to steps S402-406 are executed at steps S409-S413 for the corrected test image. At step S412, in one or more embodiments, the PC 500 determines whether luminance measurement is to be performed for a different corrected test image, based on the user's input from the input unit 510 or saved data in an ROM. If so, in one or more embodiments, the test image generating circuitry 290 generates another test image to display another corrected test image at step S413, and processes of steps S409 to S412 are repeated.

When luminance measurement of desired corrected test images has been completed, the process proceeds to step S414. At step S414, in one or more embodiments, the PC 500 further determines whether desired display characteristics are obtained, based on the measurement results received from the measuring device 30. When the PC 500 determines that desired display characteristics are obtained, the process completes. Otherwise, the process returns to step S401. After desired measurements of the test images are completed, the created correction parameters for voltage drop compensation are transferred to the memory 300 of the display driver 200 and stored in the memory 300.

Figure 21:
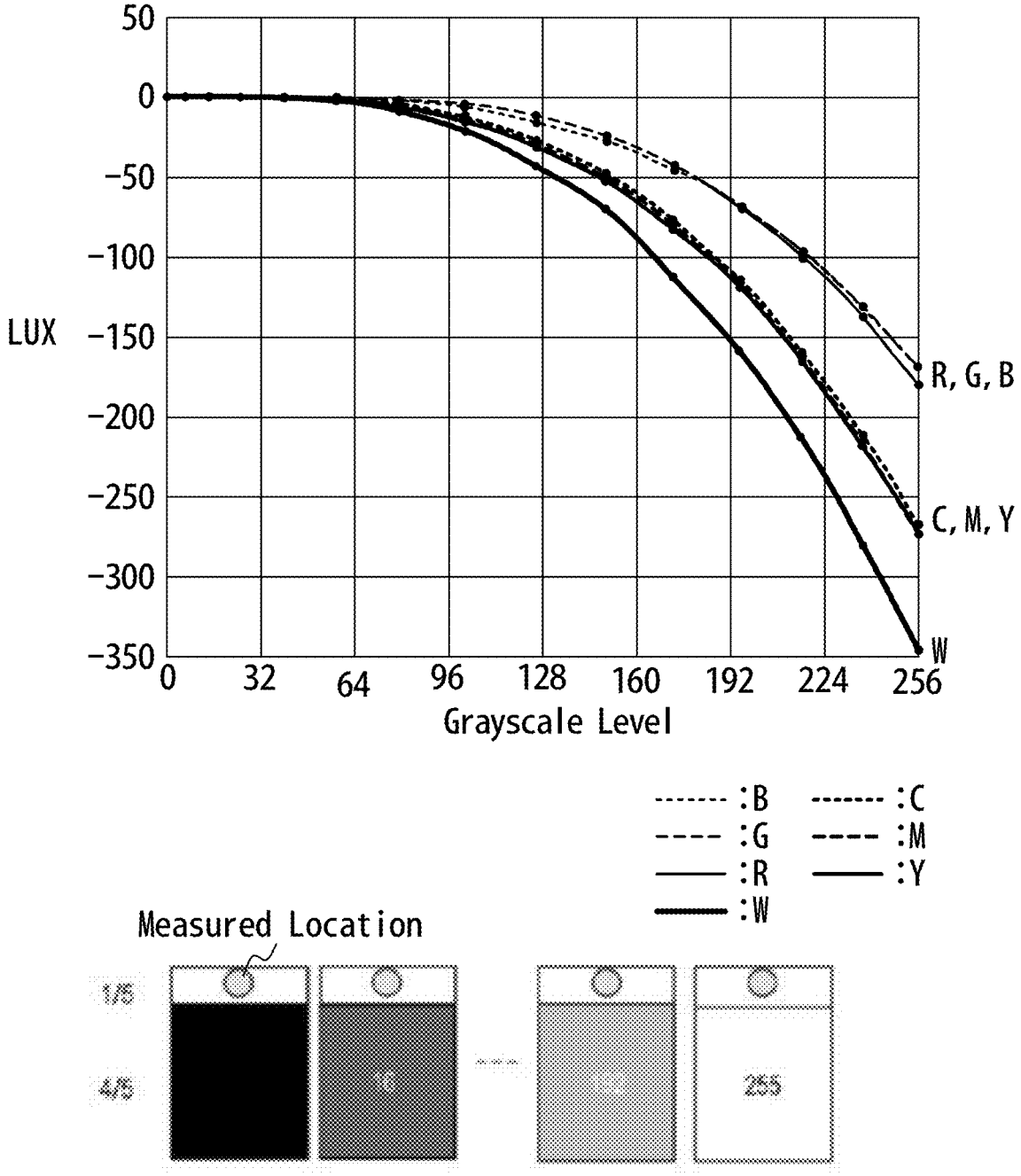
FIG. 21 illustrates an example test result of voltage drops, according to one or more embodiments.

FIG. 21 illustrates an example test result of voltage drops, according to one or more embodiments. In this example test result, a test image comprises a white front image element in a top ⅕ region, for which R, G, and B grayscale levels are specified as "255". The color of the background, that is, a bottom ⅘ region of the test image is selected from white (W), red (R), green (G), blue (B), cyan (C), magenta (M), and yellow (Y). The measurement device 30 measures the luminance level of the top ⅕ region while changing the color of the bottom ⅘ region. Although the color of the top ⅕ region is fixed to white, the luminance level of the top ⅕ region changes depending on the color in the bottom ⅘ region. The reduction in the luminance level of the top ⅕ region is enhanced as the grayscale level of the bottom ⅘ region increases. The luminance level of the top ⅕ region decreases more largely when the color of the bottom ⅘ region is any of complementary colors cyan (C), magenta (M), and yellow (Y), compared with when the color of the bottom ⅘ region is any of pure colors red (R), green (G), and blue (B). The luminance level of the top ⅕ region further decreases when the color of the bottom ⅘ region is gray or white (W). As thus described, in one or more embodiments, the display device 10 is tested with the color and grayscale level of the front image element unchanged, while the color and/or grayscale level of the background is successively changed.

Figure 22:
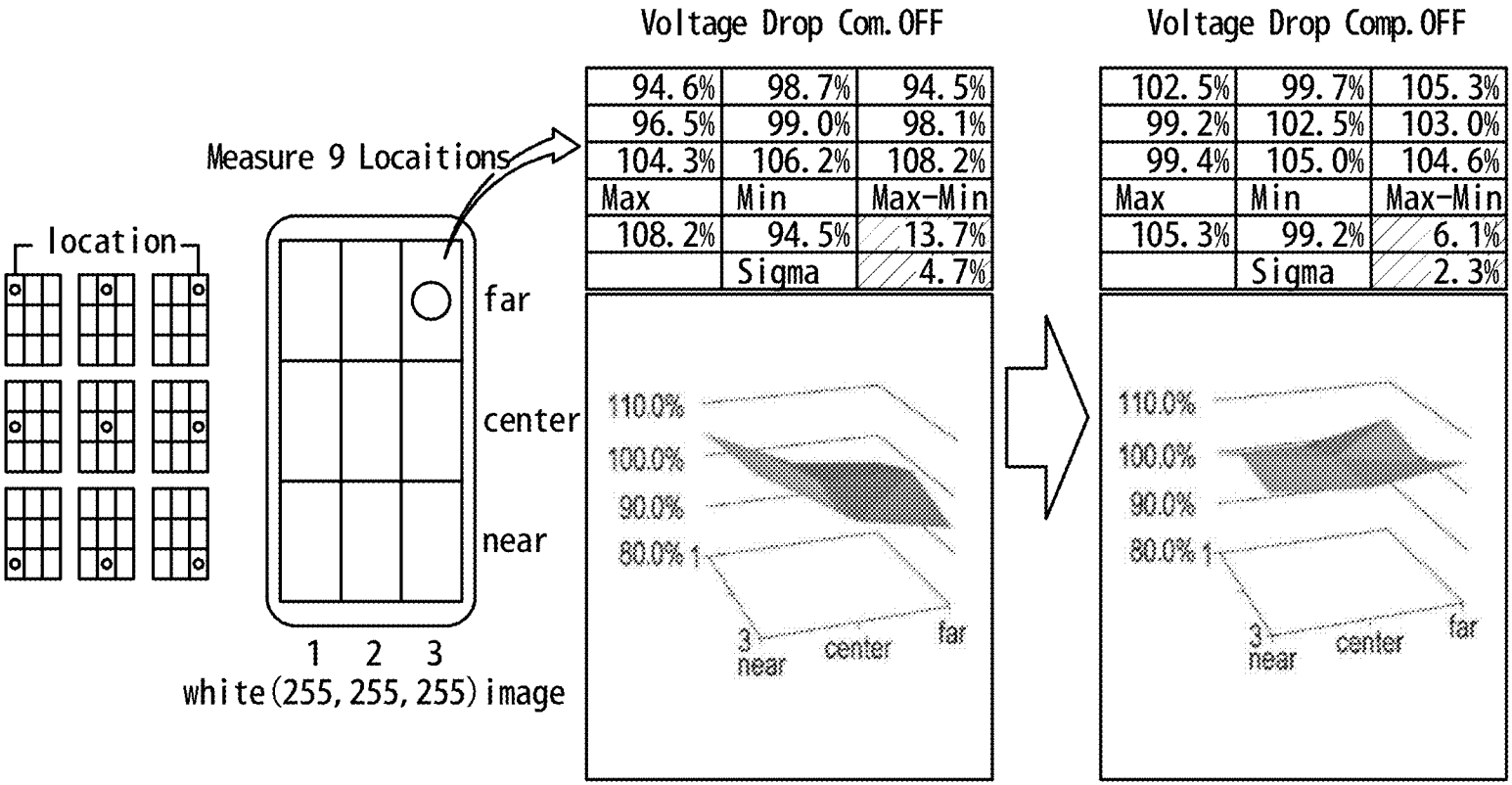
FIG. 22 illustrates an example result of voltage drop compensation, according to one or more embodiments.

FIG. 22 illustrates an example result of voltage drop compensation, according to one or more embodiments. This result is obtained for a case when a whole-white image is displayed on the display panel 100 and the display panel 100 is sectioned into nine equal areas arrayed in three rows and three columns. Graphs in FIG. 22 indicate measurement results of the luminance levels of the nine areas, and results of voltage drop compensation. The graphs illustrate that the luminance level varies depending on the location on the display panel 100 before the voltage drop compensation, and the luminance uniformity is improved when the voltage drop compensation is performed.

Figure 23:
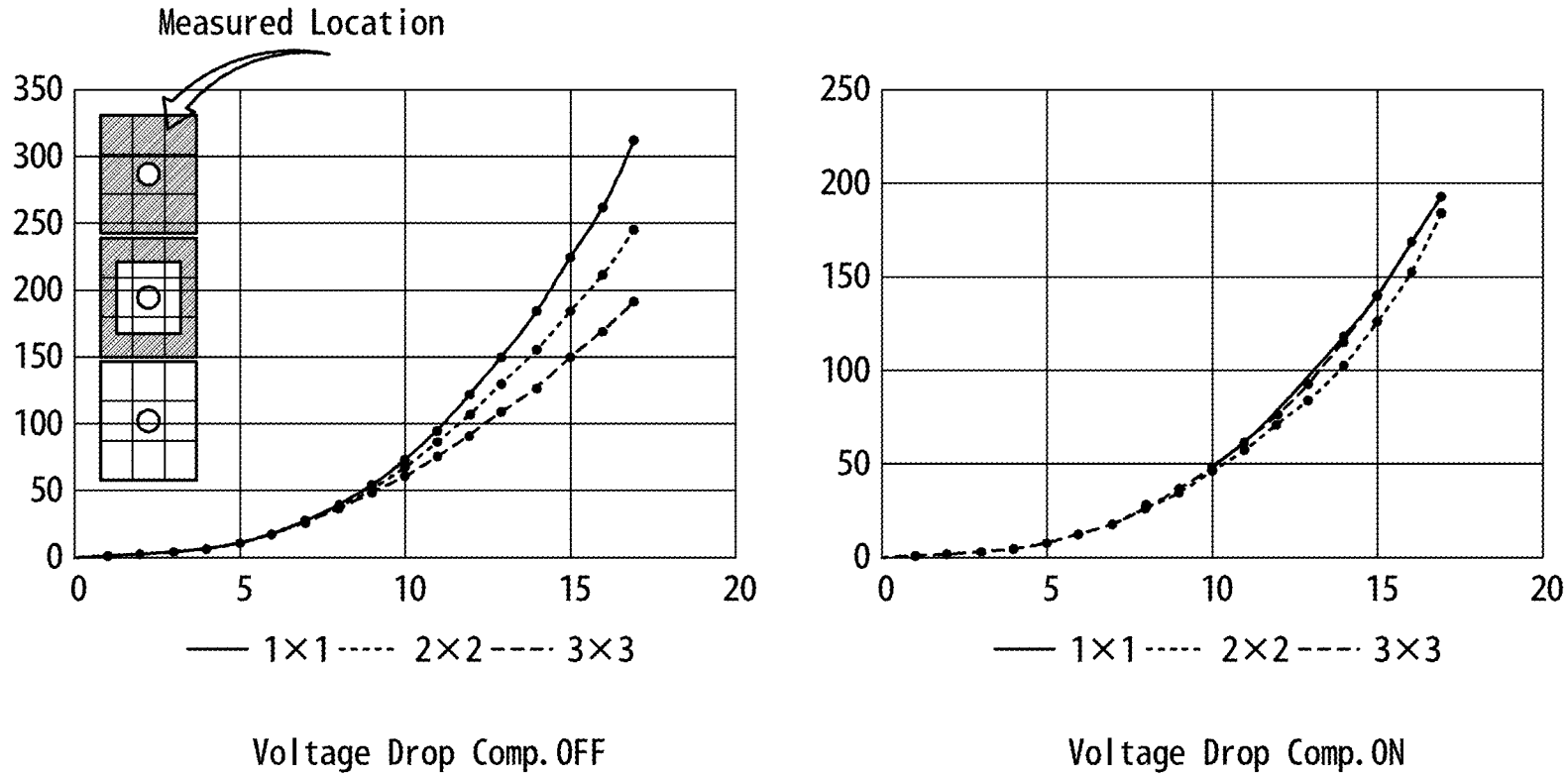
FIG. 23 illustrates another example result of voltage drop compensation, according to one or more embodiments.

FIG. 23 illustrates another example result of voltage drop compensation, according to one or more embodiments. This result is obtained for a case when a test image comprises a rectangle front image element at the center thereof, an area of the front image element is selected from ⅕, ⅘, and 9/9, and the color and grayscale level of the front image element is variously changed. The grayscale level of the background image is set to zero, and therefore the color of the background is black. The luminance level of the rectangle front image element is measured by the measuring device 30, while the area, color, and/or grayscale level are changed. Graphs in FIG. 23 indicate that the luminance level of the front image element varies depending on the area of the front image element before the voltage drop compensation, while the luminance level of the front image element remains unchanged against the area of the front image element, when the voltage drop compensation is performed.

The luminance level of the front image element may vary due to the voltage drops, depending on the color, location, grayscale level, and/or size of the front image element and the color and/or grayscale level of the background. To address this, in one or more embodiments, test images comprise front image elements of various colors, grayscale levels, sizes, and/or locations, and backgrounds of various colors and/or grayscale levels. In one or more embodiments, luminance coordinates of the test images are measured at various locations on the display panel 100. In one or more embodiments, the test image generating circuitry 290 of the display driver 200 is configured to display rectangular front image elements of various areas, colors, and grayscale levels at various locations in background images of various colors and grayscale levels. In one or more embodiments, the test system 1000 is configured to perform measurements of test images at various locations, while displaying rectangular front image elements of various areas, colors and grayscale values. In one or more embodiments, since the display driver 200 comprises the test image generating circuitry 290, the display device 10 does not receive test image data from the PC 500 when being tested. This contributes to quick generation and measurement of test images for voltage drop compensation with reduced costs.

The following are example embodiments of this disclosure.

In one or more embodiments, a display driver comprises:

digital gamma circuitry configured to generate a voltage data based on an image data for a pixel of interest;

compensating circuitry configured to calculate a total current based on subtotals of pixel currents for respective segments of a display panel, the segments each comprising a plurality of pixels; and correction circuitry configured to correct the voltage data based on the total current.

The segments of the display panel may be successively updated from a first frame image to a second frame image in a frame period. The calculating the total current may comprise:

when one of the segments is being updated in the frame period, calculating the total current based on a first subtotal for a first segment of the segments which is not yet updated in the frame period, wherein the first subtotal is calculated based on a first image data for the first frame image.

The calculating the total current may further comprise:

when the one of the segments is being updated in the frame period, calculating the total current based on a second subtotal for a second segment of the segments which has already been updated in the frame period, wherein the second subtotal is calculated based on a second image data for the second frame image.

The calculating the total current may further comprise:

when the one of the segments is being updated in the frame period, calculating the total current based on a third subtotal for the one of the segments, wherein the third subtotal is calculated based on the first image data for the first frame image.

The compensating circuitry may be further configured to calculate a first area gain for the pixel of interest, based on the total current. The correcting the voltage data may comprise generating the corrected voltage data by correcting the voltage data, based on the first area gain.

The segments of the display panel may be successively updated from a first frame image to a second frame image in a frame period. The calculating the first area gain for the pixel of interest may comprise:

calculating a second area gain based on the total current calculated when a first segment of the segments is being updated;

calculating a third area gain based on the total current calculated when a second segment of the segments is being updated, the second segment comprising the pixel of interest; and calculating the first area gain based on the second area gain and the third area gain.

In one or more embodiments, a display driver comprises:

circuitry configured to receive a command from a test system; and test image generating circuitry configured to generate a test image for voltage drop compensation for a display panel, based on the received command.

The test image may comprise a rectangular front image element located in a background.

At least one of a color and grayscale level of the background may be specified based on a first parameter stored in a memory. A location of the front image element in the background may be specified based on a second parameter stored in a memory. At least one of a width and vertical size of the front image element may be specified based on a third parameter stored in a memory. At least one of a color and grayscale level of the front image element may be specified by a fourth parameter stored in a memory.

In one or more embodiments, a test system comprises:

a processing device configured to supply a command to a display driver driving a display panel, to cause a test image generating circuitry in the display driver to generate a test image adapted to voltage drop compensation of the display panel; and a measuring device configured to measure a luminance level on the test image displayed on the display panel.

The processing device may be configured to supply to the display driver a correction parameter based on the measured luminance level, the correction parameter being used in the display driver for the voltage drop compensation.

The display driver may be configured to generate a voltage data based on an image data and correct the voltage data based on the correction parameter supplied by the processing device.

In one or more embodiments, a method comprises:

generating a test image for drop compensation of a display panel by a display driver configured to drive the display panel.

The method may further comprise:

measuring a luminance level on the test image displayed on the display panel; and supplying to the display driver a correction parameter based on the measured luminance level, the correction parameter being used in the display driver for the voltage drop compensation.

The method may further comprise:

by the display driver, generating a voltage data based on an image data in the display driver; and by the display driver, correcting the voltage data based on the correction parameter.

Although various embodiments of the present disclosure have been specifically described in the above, a person skilled in the art would appreciate that the techniques disclosed in this disclosure may be implemented with various modifications.

What is claimed is:

1. A display driver, comprising:

digital gamma circuitry configured to generate a voltage data based on an image data for a pixel of interest;

compensating circuitry configured to calculate a total current of a display panel, based on a sum of subtotals of pixel currents for a plurality of segments of the display panel, wherein the subtotals of pixel currents for the plurality of segments are successively updated segment-by-segment in synchrony with an updating of the display panel from a previous frame to a current frame, wherein, at one instant in time during the updating of the display panel:

the display panel has been updated from the previous frame to the current frame in a first segment of the plurality of segments, and the display panel has not been updated from the previous frame to the current frame in a second segment of the plurality of segments following the first segment, and wherein the successive updating of the subtotals of pixel currents comprises:

selecting for the sum of the subtotals of pixel currents, a first subtotal of pixel currents for the first segment based on the current frame, and a second subtotal of pixel currents for the second segment based on the previous frame; and correction circuitry configured to correct the voltage data based on the total current.

2. The display driver according to claim 1, wherein the voltage data is corrected further based on a location of the pixel of interest.

3. The display driver according to claim 2, wherein the compensating circuitry is further configured to calculate a gain data for the pixel of interest based on the total current and the location of the pixel of interest, and wherein the voltage data is corrected based on the gain data.

4. The display driver according to claim 3, wherein calculating the gain data comprises:

obtaining an area gain based on the total current;

obtaining a location gain based on the location of the pixel of interest; and multiplying the area gain and the location gain.

5. The display driver according to claim 3, wherein the voltage data is corrected by multiplying the voltage data by the gain data.

6. The display driver of claim 1, wherein the plurality of segments is arranged in a vertical direction of the display panel, each of the plurality of segments comprising a plurality of rows of pixels in a horizontal direction of scan lines of the display panel.

7. The display driver of claim 1, wherein, at the one instant in time during the updating of the display panel:

the display panel is being updated from the previous frame to the current frame in a third segment of the plurality of segments between the first segment and the second segment, and wherein the successive updating of the subtotals of pixel currents further comprises:

selecting for the sum of the subtotals of pixel currents, a third subtotal of pixel currents for the third segment based on the previous frame.

8. A display device, comprising:

a display panel; and a display driver configured to:

generate a voltage data based on an image data for a pixel of interest;

calculate a total current of the display panel, based on a sum of subtotals of pixel currents for a plurality of segments of the display panel, wherein the subtotals of pixel currents for the plurality of segments are successively updated segment-by-segment in synchrony with an updating of the display panel from a previous frame to a current frame, wherein, at one instant in time during the updating of the display panel:

the display panel has been updated from the previous frame to the current frame in a first segment of the plurality of segments, and the display panel has not been updated from the previous frame to the current frame in a second segment of the plurality of segments following the first segment, and wherein the successive updating of the subtotals of pixel currents comprises:

selecting for the sum of the subtotals of pixel currents, a first subtotal of pixel currents for the first segment based on the current frame, and a second subtotal of pixel currents for the second segment based on the previous frame; and correct the voltage data based on the total current.

9. The display device of claim 8, wherein the plurality of segments is arranged in a vertical direction of the display panel, each of the plurality of segments comprising a plurality of rows of pixels in a horizontal direction of scan lines of the display panel.

10. The display device of claim 8, wherein, at the one instant in time during the updating of the display panel:

the display panel is being updated from the previous frame to the current frame in a third segment of the plurality of segments between the first segment and the second segment, and wherein the successive updating of the subtotals of pixel currents further comprises:

selecting for the sum of the subtotals of pixel currents, a third subtotal of pixel currents for the third segment based on the previous frame.

11. A method, comprising:

generating a voltage data based on an image data for a pixel of interest;

calculating a total current of a display panel, based on a sum of subtotals of pixel currents for a plurality of segments of the display panel, wherein the subtotals of pixel currents for the plurality of segments are successively updated segment-by-segment in synchrony with an updating of the display panel from a previous frame to a current frame, wherein, at one instant in time during the updating of the display panel:

the display panel has been updated from the previous frame to the current frame in a first segment of the plurality of segments, and the display panel has not been updated from the previous frame to the current frame in a second segment of the plurality of segments following the first segment, and wherein the successive updating of the subtotals of pixel currents comprises:

selecting for the sum of the subtotals of pixel currents, a first subtotal of pixel currents for the first segment based on the current frame, and a second subtotal of pixel currents for the second segment based on the previous frame; and correcting the voltage data based on the total current.

12. The method according to claim 11, wherein the plurality of segments is arranged in a vertical direction of the display panel, each of the plurality of segments comprising a plurality of rows of pixels in a horizontal direction of scan lines of the display panel.

13. The method according to claim 11, wherein, at the one instant in time during the updating of the display panel:

the display panel is being updated from the previous frame to the current frame in a third segment of the plurality of segments between the first segment and the second segment, and wherein the successive updating of the subtotals of pixel currents further comprises:

selecting for the sum of the subtotals of pixel currents, a third subtotal of pixel currents for the third segment based on the previous frame.

* * * * *